US010456759B2

(12) United States Patent
Henry et al.

(10) Patent No.: US 10,456,759 B2
(45) **Date of Patent: *Oct. 29, 2019**

(54) PAINT MAKER AND MIXING DEVICE

(71) Applicant: CRAYOLA, LLC, Easton, PA (US)

(72) Inventors: Robert Henry, Easton, PA (US); Cheryl Krieger, Easton, PA (US); James Allen, Easton, PA (US)

(73) Assignee: Crayola LLC, Easton, PA (US)

( * ) Notice: Subject to any disclaimer, the term of this patent is extended or adjusted under 35 U.S.C. 154(b) by 148 days.

This patent is subject to a terminal disclaimer.

(21) Appl. No.: 15/725,013

(22) Filed: Oct. 4, 2017

(65) Prior Publication Data

US 2018/0028989 A1 Feb. 1, 2018

Related U.S. Application Data

(63) Continuation of application No. 14/626,658, filed on Feb. 19, 2015, now Pat. No. 9,808,777.
(Continued)

(51) Int. Cl.
*B01F 11/00* (2006.01)
*B01F 13/00* (2006.01)
(Continued)

(52) U.S. Cl.
CPC ..... *B01F 11/0008* (2013.01); *A63H 33/00* (2013.01); *B01F 11/0017* (2013.01); *B01F 11/0025* (2013.01); *B01F 11/0097* (2013.01); *B01F 13/0033* (2013.01); *B01F 15/0074* (2013.01); *B01F 15/00506* (2013.01); *B44B 5/0085* (2013.01); *B44D 3/003* (2013.01);
(Continued)

(58) Field of Classification Search
CPC ..... B01F 11/0008; B01F 11/0017; B01F 11/0097; B01F 11/0005; B01F 11/0037; B01F 13/0033; B01F 15/0074; B01F 2215/005; A63H 33/00
USPC ..... 366/110, 209; 273/459
See application file for complete search history.

(56) References Cited

U.S. PATENT DOCUMENTS 814,196 A * 3/1906 Forsyth ..... B01F 11/0022 366/212

FOREIGN PATENT DOCUMENTS

WO 2013080190 A1 6/2013

OTHER PUBLICATIONS

European Search Report dated Nov. 7, 2017 in European Patent Application No. 15751419.1, 9 pages.

* cited by examiner

*Primary Examiner* — Marc C Howell
(74) *Attorney, Agent, or Firm* — Shook Hardy & Bacon, LLP

(57) ABSTRACT

A mixing and paint-making device and method for making paint are described. Embodiments of the paint-making device include a first and second palette hingedly coupled to a base. The base includes a paint pot shaking component configured to agitate and/or translate a paint pot. The paint pot shaking component includes a series of gears and pistons that interact to produce a shaking motion for a paint pot coupled to the paint pot shaking component. In one embodiment, the paint pot shaking component includes a crank gear adjacent a combination gear that contacts a slide crankshaft. The slide crankshaft is coupled to a slide crank arm that is secured by slide bracket coupled to the base. A paint pot harness holds a paint pot during agitation and moves in an upward and downward motion corresponding to the motion of the slide crank arm.

18 Claims, 16 Drawing Sheets

Related U.S. Application Data

(60) Provisional application No. 61/942,346, filed on Feb. 20, 2014.

(51) Int. Cl.

| | |
|---|---|
| ***B01F 15/00*** | (2006.01) |
| ***A63H 33/00*** | (2006.01) |
| ***B44B 5/00*** | (2006.01) |
| ***B44D 3/00*** | (2006.01) |
| ***B44D 3/02*** | (2006.01) |
| ***B44D 3/08*** | (2006.01) |

(52) U.S. Cl.
CPC ..... *B44D 3/02* (2013.01); *B44D 3/08* (2013.01); *B01F 2215/005* (2013.01)

PAINT MAKER AND MIXING DEVICE

CROSS REFERENCE TO RELATED APPLICATION

This application is a continuation of U.S. patent application Ser. No. 14/626,658, entitled "Paint Maker and Mixing Device," filed Feb. 19, 2015, which claims priority to U.S. Provisional Patent Application No. 61/942,346, also entitled "Paint Maker and Mixing Device," filed Feb. 20, 2014, the entirety of which are hereby incorporated by reference.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed description section below. This summary is not intended to identify key features or essential features of the claimed subject matter, nor is it intended to be used as an aid in isolation to determine the scope of the claimed subject matter.

In brief and at a high level, this disclosure describes, among other things, a paint-making and mixing device and a method of mixing and/or making paint. In embodiments, the paint-making and mixing device includes a manually-powered paint pot shaking component configured to mix a minimum amount of a base paint formula with at least one colored, dissolvable paint strip. As such, embodiments of the manually-powered paint pot shaking device include a hand-cranked linkage that enables the paint-making device to agitate a paint pot harnessed to a portion of the device. For example, based on rotation of the hand-cranked linkage, the harness secures a paint pot as it "bobs" up and down rapidly, allowing the base paint solution to dissolve the paint strips and produce a desired color.

In further embodiments, a mixing device for mixing two components is provided, such as a mixing device for combining a fluid component with at least one additional component (e.g., a device for mixing a colorant in a base formulation, a paint solution, colored glue, and/or a glitter in glue). Embodiments of the mixing device include a manually-powered paint pot shaking component that secures a container for mixing based on manipulation of a hand-cranked linkage. As such, while embodiments of the invention may be referred to as "paint pot" components/harnesses and/or "paint mixing" features, such components or features may refer generally to those portions of the device used to mix or combine two distinct components into a single mixture. Additionally, components that interact with the "paint pot" may be configured to secure and/or hold other containers for mixing, according to some embodiments of the invention. As such, while a paint pot harness may be used to secure one or more different types of paint pot components, such harness may, in further embodiments, secure one or more different types of containers that enclose desired components for mixing. For example, a paint pot harness may secure a mixing cup capable of mixing contents of the mixing cup, utilizing one or more features of a paint pot shaking component. As such, manipulation of the hand-cranked linkage and agitation of the paint pot shaking component may provide a portable mixing tool for a user-facilitated mixing with minimal user rotation of a crank gear that generates maximal mixing capabilities at a remote, secured mixing compartment.

According to various embodiments, one or more features of the mixing device may be used to secure a mixing container in a harness adjacent an agitation component that provides a threshold amount of rapid upward and downward motion/travel of the mixing container such that the contents of the mixing container are combined over time during agitation. For example, one embodiment of the mixing device may be used to mix a colorant feature into a base paint, both enclosed within the mixing container, by rapidly agitating the mixing container upward and downward in response to a user turning the hand-cranked mixing component. In another example, the mixing device may be used to mix a glue additive, such as a glitter component, into a base glue component to provide a combined glitter glue mixture upon rapid agitation with the mixing device, in response to a threshold amount of turning of the hand-cranked apparatus. For example, a user may manipulate the hand-cranked apparatus by five rotations of the crank gear, resulting in minimal cycles of upward and downward agitation of the mixing container. Such minimal rotation, and corresponding minimal cycles of agitation, may result in minimal mixing of the additive with the base component (e.g., glitter still separated from glue). However, in another example, a user may manipulate the hand-cranked apparatus by 25 rotations of the crank gear, resulting in optimal cycles of upward and downward agitation of the mixing container. Such optimal rotation, and corresponding optimal cycles of agitation, may result in optimal mixing of the additive with the base component (e.g., more thorough mixing of the glitter within the glue).

A dissolvable coloring feature may be agitated by the mixing component to provide a desired mixed paint, according to embodiments of the invention. In one example, colored "paint strips" for use with the paint-making and mixing device are colored, dissolvable strips that have been "kiss-cut" and/or perforated for separating or tearing of individual strips from a portion of the paint strip. In embodiments of the invention, a paint strip and/or colored, dissolvable strip may be referred to as a dissolvable strip containing colorant and/or a colorant component. In further embodiments of the invention, the paint-making and mixing device is configured to mix any type of colorant component into a base solution, such as a gel colorant, powder colorant, dissolvable strip colorant, liquid colorant, pelletized colorant, and other materials containing a colorant for mixing. In further aspects of the invention, the number and color of colorant components added to the base solution may be adjusted to generate a resulting paint color that directly corresponds to the number, color, and/or type of colorant components being mixed into the base solution. For example, a number and/or color of different colorant components may be altered by a user to adjust a shade, color intensity, a color depth, a tone, and/or a customized quality of a customized paint mixed with the paint mixing device.

In one embodiment, a manual cutting tool is provided for pressing against a surface of a colorant material and/or complete paint strip, to provide a series of scores for breaking or separating the sheet into separate strips. In some embodiments, multiple paint strips may be mixed with an amount of base paint, and the paint-making device may be provided with a color-mixing guide to demonstrate the creation of specific color shades based on suggested amounts and/or combinations of two or more different paint strips. Accordingly, the color-mixing guide may provide information on a ratio (i.e., number of paint strips) of different colors for combining to produce a designated shade of color. In some embodiments, the paint-making device includes multiple, empty paint pots for mixing paint, and a number of additional accessories for use with the device. For example, a first paint pot may be used to mix a first shade of purple including one blue strip and one red strip of a dissolvable colorant component. In another example, a second shade of purple may be mixed using two blue strips and three red strips of a dissolvable colorant component. As such, a concentration per unit of colorant component may be used to measure a particular desired color for mixing. In further aspects of the invention, a recommended range of a number of times for rotation of the hand-cranked component may be provided such that an optimal amount of paint mixing results (i.e., optimal combination and/or dissolving of the paint strips in the base paint).

In some embodiments, the paint-making device is configured to include a base unit with a paint pot shaking component, a first palette for holding multiple paint pots, and a second palette for holding additional accessories such as paint strips, paintbrushes, paint pots, paint bottles, and the like. The first and second palettes may be hingedly attached to the base, to provide a collapsible and/or portable paint-making device. As such, the paint-making device serves as a storage device for one or more paint pots. Further, by collapsing the first and second palettes towards the base, the paint-making device becomes a portable unit for both storage and paint mixing. For example a top surface of the first paint palette and a top surface of the second paint palette may be rotated from a position adjacent the base, to a position perpendicular to the base. In another aspect, a handle may be coupled to the first and second paint palettes, thereby enclosing at least a portion of the base and mixing features, and providing a portable paint mixing device.

Accordingly, in one embodiment of the invention, a paint-making device includes a first palette, a second palette, and a base coupled to the first palette and the second palette. The base includes a paint pot shaking component configured to agitate a paint pot coupled to the base. In one embodiment, the first palette includes a plurality of paint pot holders. In further embodiments, the second palette includes one or more of the following: a paint strip compartment configured to enclose at least one paint strip; a paint bottle compartment configured to secure at least one paint bottle; at least one paint pot holder configured to secure at least one paint pot; and at least one paintbrush holder configured to secure at least one paintbrush.

In some embodiments, the paint pot shaking component is configured to agitate a paint pot coupled to the base in response to rotation of at least a portion of the paint pot shaking component. Further, the paint pot shaking component may include a plurality of gears, pistons, and/or other features to provide a shaking motion for a paint pot. In embodiments, the paint pot shaking component includes a crank gear; a combination gear adjacent the crank gear; a slide crankshaft adjacent the combination gear; a slide crank arm coupled to the slide crankshaft; a vertical piston side support coupled to the base; a slide bracket coupled to the slide crank arm and to the vertical piston side support; and a paint pot harness coupled to the slide bracket. The paint pot harness may be configured to hold other mixing containers in addition to a paint pot. In further embodiments, rotation of the crank gear causes rotation of the combination gear about a first axis of rotation, and upon rotation of the combination gear about a first axis of rotation, the slide crankshaft rotates about a second axis of rotation perpendicular to the first axis of rotation. In further embodiments, rotation of the slide crankshaft about the second axis of rotation causes translational movement of the slide crank arm.

In another embodiment of the invention, a paint-making device includes a base comprising a paint pot shaking component configured to agitate a paint pot coupled to the base, wherein the paint pot is configured to receive a first amount of base paint and at least one paint strip, wherein upon rotation of at least a portion of the paint pot shaking component, the base paint and the paint strip are combined. In embodiments, the paint pot shaking component includes a crank gear; a combination gear adjacent the crank gear; a slide crankshaft adjacent the combination gear; a slide crank arm coupled to the slide crankshaft; a vertical piston side support coupled to the base; a slide bracket coupled to the slide crank arm and the vertical piston side support; and a paint pot harness coupled to the slide bracket. In further embodiments, rotation of the crank gear causes rotation of the combination gear about a first axis of rotation, and upon rotation of the combination gear about a first axis of rotation, the slide crankshaft rotates about a second axis of rotation perpendicular to the first axis of rotation. Additionally, rotation of the slide crankshaft about the second axis of rotation causes translational movement of the slide crank arm. In embodiments, translational movement of the slide crank arm corresponds to movement of the paint pot harness.

Embodiments of a paint-making device include a first palette configured to receive a plurality of paint pots; a second palette configured to receive at least one accessory; and a base hingedly coupled to the first and second palettes, wherein the first palette is pivotable between a first position parallel to the base and a second position perpendicular to the base, wherein the second palette is pivotable between a third position parallel to the base and a fourth position perpendicular to the base, wherein the base comprises a paint pot shaking component configured to translate a paint pot coupled to the paint pot shaking component. In embodiments, a first side of the first palette includes a plurality of holders configured to receive the plurality of paint pots, while a second side of the first palette includes a plurality of apertures corresponding to at least a portion of each of the plurality of holders. Further, in some embodiments, at least a portion of the contents of at least one paint pot received by the first side of the first palette is viewed from the second side of the first palette.

In some embodiments, the second palette includes one or more of the following: a paint strip compartment configured to enclose at least one paint strip; a paint bottle compartment configured to secure at least one paint bottle; at least one paint pot holder configured to secure at least one paint pot; and at least one paintbrush holder configured to secure at least one paintbrush. Further, embodiments of the paint-making device include a handle having a first end and a second end, wherein the first end of the handle is configured to couple to the first palette, and wherein the second end is configured to couple to the second palette. In embodiments, translating a paint pot coupled to the paint pot shaking component includes mixing at least one paint strip and an amount of base paint in a paint pot secured by the paint pot shaking component. Embodiments of the paint pot shaking component include a crank gear arranged in a first plane; a combination gear adjacent the crank gear, the combination gear arranged in a second plane parallel to the first plane; a slide crankshaft adjacent the combination gear, the slide crankshaft comprising a slide crankshaft gear configured to couple to the combination gear, wherein at least a portion of the slide crankshaft is arranged in a third plane parallel to the first and second planes; a slide crank arm coupled to the slide crankshaft, the slide crank arm arranged in a plane perpendicular to the first, second, and third planes; a vertical piston side support coupled to the base; a slide bracket coupled to the slide crank arm and the vertical piston side support; and a paint pot harness coupled to the slide bracket. In further embodiments, the crank gear includes a first plurality of gear teeth, while the combination gear includes a second plurality of gear teeth and a third plurality of gear teeth, and the slide crankshaft gear includes a fourth plurality of gear teeth. As such, the first plurality of gear teeth are configured to engage the second plurality of gear teeth, and the third plurality of gear teeth are configured to engage the fourth plurality of gear teeth. In embodiments of the invention, upon rotation of the crank gear in a first direction, the combination gear is configured to rotate in a second direction, and upon rotation of the combination gear in the second direction, the slide crankshaft gear and slide crankshaft are configured to rotate in a third direction. In additional embodiments, the slide crank arm is configured to move in an upward and downward direction based on rotation of the slide crankshaft, and further wherein the slide bracket is configured to translate with respect to the vertical piston side support in response to the upward and downward movement of the slide crank arm.

DESCRIPTION OF THE DRAWINGS

Illustrative embodiments of the invention are described in detail below with reference to the attached drawing figures, and wherein.

DETAILED DESCRIPTION

Figure 1:
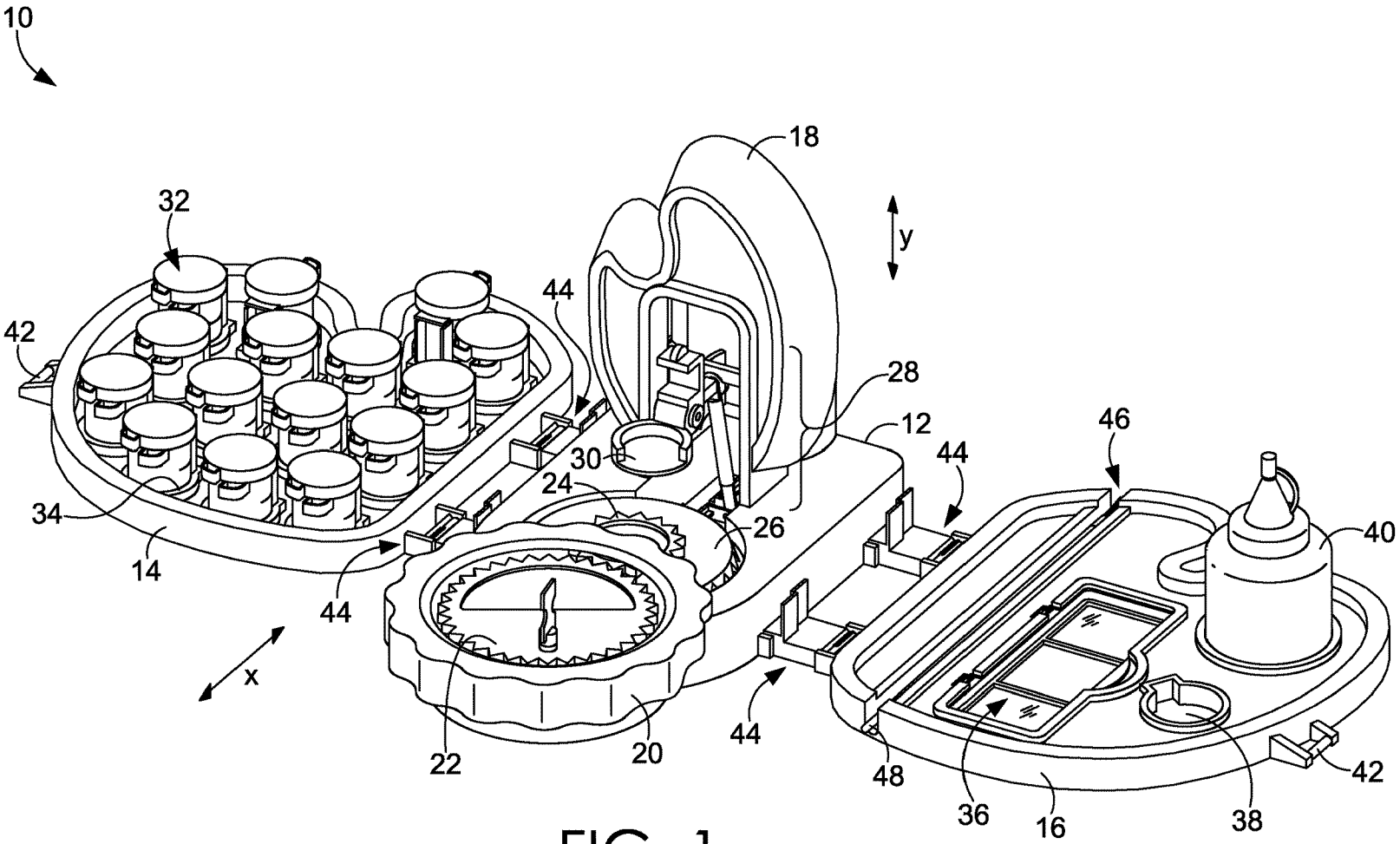
FIG. 1 is a perspective view of a paint-making device in an expanded position, with a first palette and a second palette coupled to a base, in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention provide a paint-making and mixing device and a method for making paint. In one embodiment, the paint-making device includes a manually-powered paint pot shaking component configured to mix a minimum amount of a base paint formula with at least one colored, dissolvable paint strip and/or colorant. In embodiments, the dissolvable paint strip is a dissolvable paint strip such as that disclosed in U.S. Provisional Patent Application No. 61/674,605, filed Jul. 23, 2012, entitled "Dissolvable Films and Methods of Using the Same," and PCT Application No. PCT/US2012/062952, filed Nov. 1, 2012, entitled "Dissolvable Films and Methods of Using the Same," the disclosure of both of which is hereby incorporated by reference in its entirety. In embodiments, the paint-making device is configured to combine one or more dissolvable paint strips into an amount of base paint based on mixing with manual agitation of at least a part of the device.

As such, embodiments of the manually-powered paint pot shaking device include a hand-cranked linkage that enables the paint-making device to agitate a paint pot harnessed to a portion of the device. For example, based on rotation of the hand-cranked linkage, the harness secures a paint pot as it "bobs" up and down rapidly, allowing the base paint solution to dissolve the paint strips and produce a desired color. In one embodiment, the agitation by the hand-cranked linkage provides a sequential upward and corresponding downward travel of the paint pot harness, which rapidly positions the secured paint pot in alternating directions during continuous travel over time. In some embodiments, the manually powered paint pot shaking device includes a first, hand-cranked gear coupled to a series of gears corresponding to a linkage/connection to the paint pot harness that moves the paint pot harness repeatedly and rapidly between a requisite range of motion for mixing corresponding to manipulation by the user.

In embodiments, the paint strips for use with the paint-making device are a dissolvable strip that has been "kiss-cut" and/or perforated for tearing of individual strips from a portion of the paint strip. In one embodiment, a manual cutting tool is provided for pressing against a surface of a colorant material and/or complete paint strip, to provide a series of scores for breaking the sheet into separate strips. In some embodiments, multiple paint strips may be mixed with an amount of base paint, and the paint-making device may be provided with a color-mixing guide to demonstrate the creation of specific color shades based on suggested amounts and/or combinations of two or more different strips of colorant. Accordingly, the color-mixing guide may provide information on a ratio (i.e., number of paint strips) of each color for combining to produce a designated shade of color. In some embodiments, the paint-making device includes multiple, empty paint pots for mixing paint, and a number of additional accessories for use with the device.

In some embodiments, the paint-making device is configured to include a base unit with a paint pot shaking component, a first palette for holding multiple paint pots, and a second palette for holding additional accessories, such as paint strips, paintbrushes, paint pots, paint bottles, and the like. The first and second palettes may be hingedly attached to the base, to provide a collapsible and/or portable paint-making device. As such, the paint-making device serves as a storage device for one or more paint pots. Further, by collapsing the first and second palettes towards the base, the paint-making device becomes a portable unit for both storage and paint mixing.

In one embodiment, a paint-making device includes a first palette, a second palette, and a base coupled to the first palette and the second palette. The base includes a paint pot shaking component configured to agitate a paint pot coupled to the base. In one embodiment, the first palette includes a plurality of paint pot holders. In further embodiments, the second palette includes one or more of the following: a paint strip compartment configured to enclose at least one paint strip; a paint bottle compartment configured to secure at least one paint bottle; at least one paint pot holder configured to secure at least one paint pot; and at least one paintbrush holder configured to secure at least one paintbrush. In embodiments of the invention, the paint pot shaking component is configured to agitate a paint pot coupled to the base in response to rotation of at least a portion of the paint pot shaking component. Further, the paint pot shaking component may include a plurality of gears, pistons, and/or other features to provide a shaking motion for a paint pot. In embodiments, the paint pot shaking component includes a crank gear; a combination gear adjacent the crank gear; a slide crankshaft gear perpendicular to and engaged with the combination gear; a slide crankshaft coupled to a center of the slide crankshaft gear, wherein the slide crankshaft comprises a slide crankshaft joint and a slide crank arm coupled to the slide crankshaft joint; a vertical piston side support coupled to the base; a slide bracket coupled to the slide crank arm and to the vertical piston side support; a jointed armature coupled to at least one of the slide crank arm and the slide bracket, wherein the jointed armature comprises a joint at a portion of the jointed armature remote from the slide bracket; and a paint pot harness mount coupled to the jointed armature about the joint. In further embodiments, rotation of the crank gear in a first direction causes rotation of the combination gear in a second direction, wherein rotation of the combination gear in the second direction causes rotation of the slide crankshaft gear in a third direction, the third direction being perpendicular to the first direction and the second direction, wherein rotation of the slide crankshaft gear in the third direction causes rotation of the slide crankshaft and slide crankshaft joint in the third direction about an axis of rotation, and further wherein rotation of the slide crankshaft joint in the third direction causes translational movement of the slide crank arm.

In another embodiment of the invention, a paint-making device includes a base comprising a mixing pot shaking component configured to agitate a mixing pot coupled to the base, wherein the mixing pot is configured to receive a first amount of a base component and at least one mixing component, wherein upon rotation of at least a portion of the mixing pot shaking component, the base component and the mixing component are combined. In embodiments, mixing pot shaking component includes a crank gear; a combination gear adjacent the crank gear; a slide crankshaft gear perpendicular to and engaged with the combination gear; a slide crankshaft coupled to at least a portion of the slide crankshaft gear, said slide crankshaft comprising a slide crankshaft joint; a slide crank arm coupled to the slide crankshaft joint; a vertical piston side support coupled to the base; a slide bracket coupled to the slide crank arm and to the vertical piston side support; a jointed armature coupled to at least one of the slide crank arm and the slide bracket; and a paint pot harness mount coupled to the slide bracket. In further embodiments, rotation of the crank gear in a first direction causes rotation of the combination gear in a second direction, wherein rotation of the combination gear in the second direction causes rotation of the slide crankshaft gear in a third direction, the third direction being perpendicular to the first direction and the second direction, wherein rotation of the slide crankshaft gear in the third direction causes rotation of the slide crankshaft and slide crankshaft joint in the third direction about an axis of rotation, and further wherein rotation of the slide crankshaft joint in the third direction causes translational movement of the slide crank arm. In embodiments, the translational movement of the slide crank arm corresponds to a translational movement of a paint pot harness mount. It should be appreciated that in some embodiments, that the paint pot harness could be configured to hold more than one paint pot and could be employed to shake multiple paint pots.

In an additional embodiment, the paint-making device includes a first palette configured to receive a plurality of paint pots; a second palette configured to receive at least one accessory; and a base hingedly coupled to the first and second palettes, wherein the first palette is pivotable between a first position parallel to the base and a second position perpendicular to the base, wherein the second palette is pivotable between a third position parallel to the base and a fourth position perpendicular to the base, wherein the base comprises a paint pot shaking component configured to translate a paint pot coupled to the paint pot shaking component. In embodiments, a first side of the first palette comprises a plurality of holders configured to receive the plurality of paint pots, wherein a second side of the first palette comprises a plurality of apertures corresponding to at least a portion of each of the plurality of holders. Further, in some embodiments, at least a portion of the contents of at least one paint pot received by the first side of the first palette is viewed from the second side of the first palette In some embodiments, the second palette includes one or more of the following: a paint strip compartment configured to enclose at least one paint strip; a paint bottle compartment configured to secure at least one paint bottle; at least one paint pot holder configured to secure at least one paint pot; and at least one paintbrush holder configured to secure at least one paintbrush. Further, embodiments of the paint-making device include a handle having a first end and a second end, wherein the first end of the handle is configured to couple to the first palette, and wherein the second end is configured to couple to the second palette. In embodiments, translating a paint pot coupled to the paint pot shaking component includes mixing at least one paint strip and an amount of base paint in a paint pot secured by the paint pot shaking component. Embodiments of the paint pot shaking component include a crank gear arranged in a first plane; a combination gear adjacent the crank gear, at least a portion of the combination gear arranged in a second plane parallel to the first plane; a slide crankshaft adjacent to the combination gear, the slide crankshaft comprising a slide crankshaft gear configured to couple to the combination gear and a slide crankshaft joint, wherein at least a portion of the slide crankshaft is arranged in a third plane parallel to the first and second planes; a slide crank arm coupled to the slide crankshaft joint, the slide crank arm arranged in a fourth plane perpendicular to the first, second, and third planes; a vertical piston side support coupled to the base; a slide bracket coupled to the slide crank arm and the vertical piston side support; and a paint pot harness coupled to the slide bracket. In further embodiments, a first plurality of gear teeth, wherein the combination gear comprises a second plurality of gear teeth and a third plurality of gear teeth, wherein the slide crankshaft gear comprises a fourth plurality of gear teeth, wherein the first plurality of gear teeth are configured to engage the second plurality of gear teeth, and wherein the third plurality of gear teeth are configured to engage the fourth plurality of gear teeth. As such, rotation of the crank gear in a first direction, the combination gear is configured to rotate in a second direction, and further wherein upon rotation of the combination gear in the second direction, the slide crankshaft gear, slide crankshaft and slide crankshaft joint are configured to rotate in a third direction.

In embodiments of the invention, upon rotation of the crank gear in a first direction, the combination gear is configured to rotate in a second direction, and upon rotation of the combination gear in the second direction, the slide crankshaft gear and slide crankshaft are configured to rotate in a third direction, the third direction being perpendicular to the first direction and the second direction. A slide crankshaft joint also rotates in the third direction, with the arc of rotational travel being greater than that of the slide crankshaft. Additionally, the slide crank arm is configured to move in a fourth upward and downward direction based to a degree corresponding to the rotational travel of the slide crankshaft joint. Further, the slide bracket is configured to translate with respect to the vertical piston side support in response to the upward and downward movement of the slide crank arm. In further embodiments, the paint pot harness mount moves in an upward and downward motion corresponding to the upward and downward motion of the slide crank arm. In embodiments, the slide crank arm is configured to move in an upward and downward direction based on rotation of the slide crankshaft, and further wherein the slide bracket is configured to translate with respect to the vertical piston side support in response to the upward and downward movement of the slide crank arm.

In embodiments of the invention, upon rotation of the crank gear in a first direction, a combination gear is configured to rotate in a second direction, upon rotation of the combination gear and the second direction, a slide crankshaft gear, slide crankshaft, and slide crankshaft joint are configured to rotate in a third direction perpendicular to the first and second directions. Upon rotation of the slide crankshaft gear in the third direction, the slide crank arm is configured to move in a fourth upward and downward direction, and based on the movement of the slide crank arm in the upward and downward direction, the paint pot harness mount is configured to move in the fourth upward and downward direction about a joint, the joint joining the paint pot harness mount to a jointed armature, the jointed armature being coupled to the slide crank arm. The paint pot harness mount is further configured to have limited travel in the upward and downward direction by virtue of intermittent contact with the upper and lower portions of the jointed armature. The paint pot harness mount contacts the upper portion of the jointed armature when moving upward and contacts the lower portioned of the jointed armature when moving downward, such that the contact limits the travel of the paint pot harness mount.

In additional embodiments, the crank gear can be located in a first plane. A first portion of the combination gear, adjacent to the crank gear, may also be located in the first plane and a second portion of the combination gear located in a second plane. Further, the slide crankshaft gear, below the combination gear, has an upper portion located, in part, in the second plane, such that the upper portion of the slide crankshaft gear is coupled with the second portion of the combination gear, and the slide crankshaft gear being oriented perpendicular to the combination gear and crank gear. A further embodiment has a slide crankshaft integrally attached to the center of the slide crankshaft gear, the slide crankshaft being oriented parallel to the combination gear and the crank gear and being positioned in a third plane parallel to the first plane and the second plane. In embodiments, the slide crankshaft, further has a slide crankshaft joint, the slide crankshaft joint having a first and a second proximate portion and a first and a second distal portion, the first and second distal portions being located remote from the slide crankshaft and the distal portion of the slide crankshaft joint extending perpendicularly away from the slide crankshaft. The slide crankshaft joint further has a slide crankshaft joint shaft joining the first and second distal portions of the slide crankshaft joint and being oriented parallel to the slide crankshaft. Further, a slide crank arm is rotationally attached to the slide crankshaft joint shaft.

In an embodiment, the slide crankshaft may be integrally attached remote from the center of the slide crankshaft gear and oriented perpendicular to the slide crankshaft gear. Further, the slide crankshaft may be integrally attached remote from the center of a slide crankshaft rotor, the slide crankshaft rotor being integrated in the base. In this embodiment, the slide crankshaft is attached at a portion of the slide crankshaft rotor that corresponds with the position and distance of attachment to the slide crankshaft gear. In this embodiment, upon rotation of the slide crankshaft gear, the slide crankshaft rotates in a circular motion corresponding to a radial distance of the slide crankshaft from the center of the slide crankshaft gear and the slide crankshaft rotor. Additionally, in this embodiment, a slide crank arm can be rotationally attached to the slide crankshaft, such that the circular motion of the slide crankshaft causes the slide crank arm to move in an upward and downward motion. The upward and downward motion of the slide crank arm further causes upward and downward motion of the paint pot harness mount.

With reference now to the figures, a paint-making device for enabling a user to mix multiple different paint colors is described in accordance with embodiments of the invention. Various embodiments are described with respect to the figures, in which like elements are depicted with like numbers.

Referring initially to FIG. 1, a perspective view of an embodiment of a paint-making device 10 is shown in an expanded position, including a base 12 coupled to a first palette 14 and a second palette 16. The base 12 includes a vertical piston side support 18 coupled to the base 12. In embodiments, the vertical piston side support 18 (positioned along a y axis) is perpendicular to the base 12 (positioned along an x axis). Embodiments of the base 12 further include a paint spillover rim 20 that encircles a crank gear 22. The crank gear 22 engages with the raised portion 24 on the combination gear 26, while both gears interact to manipulate the paint pot shaking component 28. By manipulating the paint pot shaking component 28, a paint pot 32 secured by the paint pot harness 30 is agitated to produce mixing of the base paint and the paint strip(s) enclosed by the paint pot 32, according to embodiments of the invention.

In some embodiments, paint-making device 10 is configured to secure multiple paint pots 32 in the paint pot holders 34 of the first palette 14. Further, embodiments of the paint-making device 10 include a variety of tools in and/or on the second palette 16, such as the paint strip compartment 36 to enclose at least one paint strip, the paint pot holder 38 to secure at least one paint pot 32, the paint bottle 40 for providing a base paint for mixing (as secured by a portion of the second palette 16), and a paintbrush holder 46 configured to secure at least one paintbrush 48. In embodiments, the first palette 14 and the second palette 16 are coupled to the base 12 using multiple palette connector hinge clips 44. In some embodiments, the palette connector hinge clips 44 connect (e.g., pivotably couple) each of the first and second palettes 14 and 16 to the base 12 such that the paint-making device 10 is collapsible.

Figure 2:
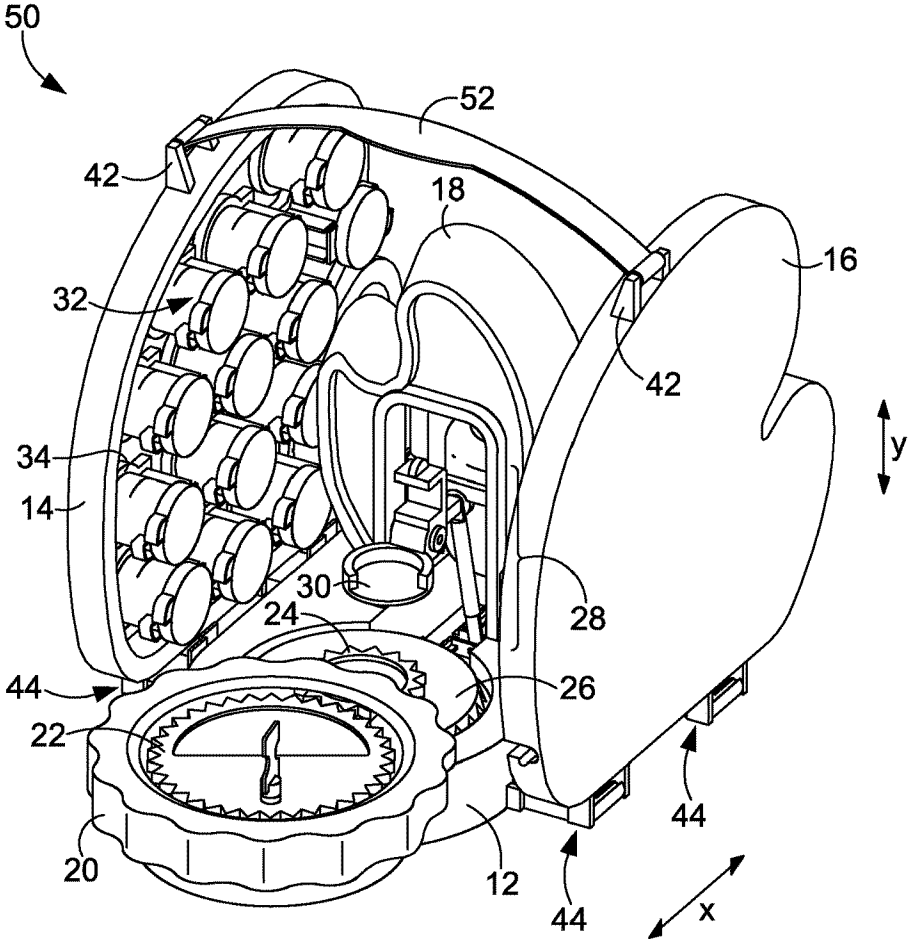
FIG. 2 is a perspective view of the paint-making device of FIG. 1 in a collapsed position, in accordance with an embodiment of the invention.

According to one embodiment, the paint-making device 10 includes at least one palette that is pivotable from an extended position to a collapsed position. For example, as shown in the collapsed paint-making device 50 of FIG. 2, the first palette 14 and the second palette 16 are collapsed into vertical positions adjacent the horizontal base 12. As shown in FIGS. 1 and 2, in some embodiments, first palette 14 and second palette 16 also include handle attachment points 42 that may be coupled to a handle 52. In embodiments, the handle 52 may be used to secure the first palette 14 and the second palette 16 in an upright position, while in further embodiments, the handle 52 may also be used for carrying the paint-making device 50.

Figure 3:
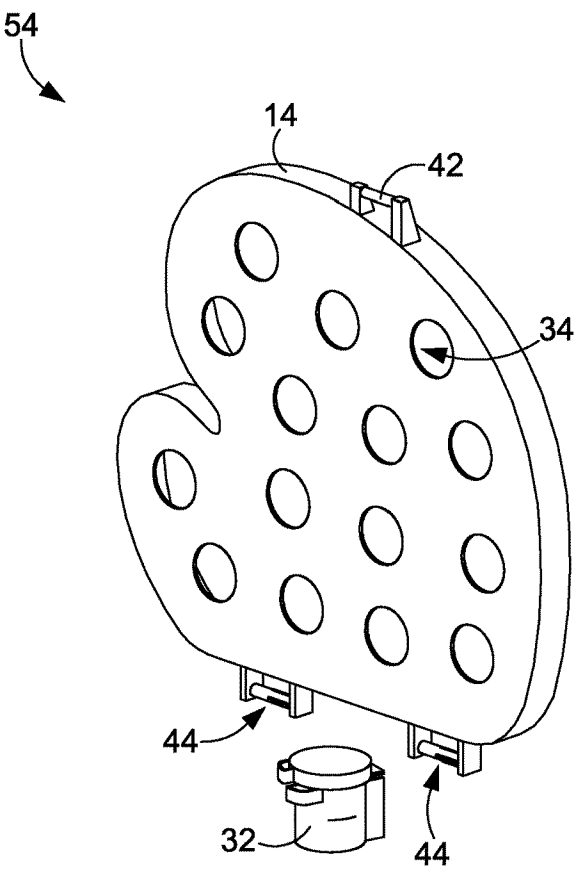
FIG. 3 is a perspective view of the second side of a first palette of the paint-making device of FIG. 1, in accordance with an embodiment of the invention.

In the exemplary embodiment of FIG. 3, a perspective view of the first palette 14 is shown detached from the base 12, and rotated to reveal the bottom and/or second side of the first palette 14. In embodiments, the bottom view of the individual paint pot holders 34 reveals the contents of the paint (or lack thereof) in each individual paint pot 32 secured by the first palette 14. As such, in some embodiments, the first palette 14 serves as a "paint palette," detachable from the base 12, for securing one or more paint pots 32 from a first side (FIG. 1) and displaying the contents of such paint pots 32 from a second side (FIG. 3). In embodiments, the visible portion of a paint pot 32 from the second side of the first palette 14 corresponds to a circular opening in the corresponding paint pot holder 34.

Figure 4:
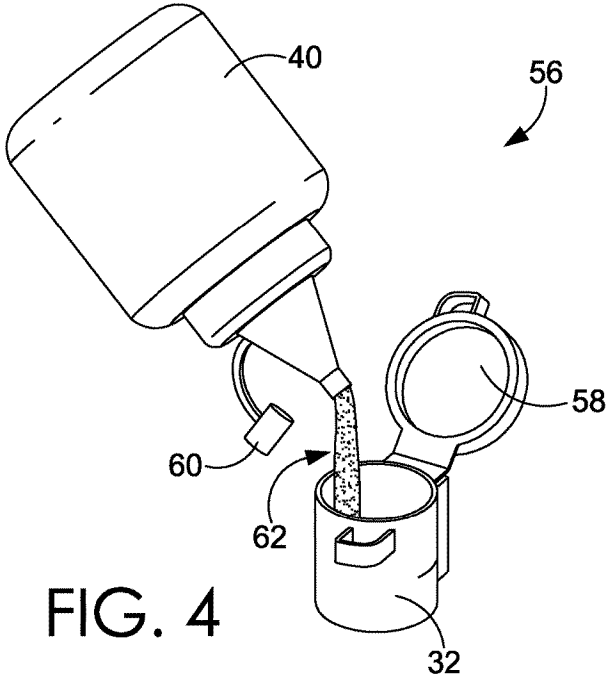
FIG. 4 is a perspective view of a paint pot filled with a base paint, for use with the paint-making device, in accordance with an embodiment of the invention.

Turning now to FIG. 4, a perspective view 56 of a paint pot 32 filled with a base paint for use with the paint-making device 10 includes a paint bottle 40 having a cap 60. The paint bottle 40 is used to dispense an amount of base paint 62 into the paint pot 32 for mixing with the paint-making device 10. The paint pot 32 is depicted as having a replaceable cap 58 that can be temporarily removed during filling of the paint pot 32, and reattached and/or secured to the paint pot 32 to form a sealed container for shaking/agitating. In embodiments, replaceable cap 58 may be coupled to at least a portion of the paint pot 32 using a living hinge that attaches the replaceable cap 58 to the paint pot 32, whether the paint pot 32 is open or closed.

Figure 5:
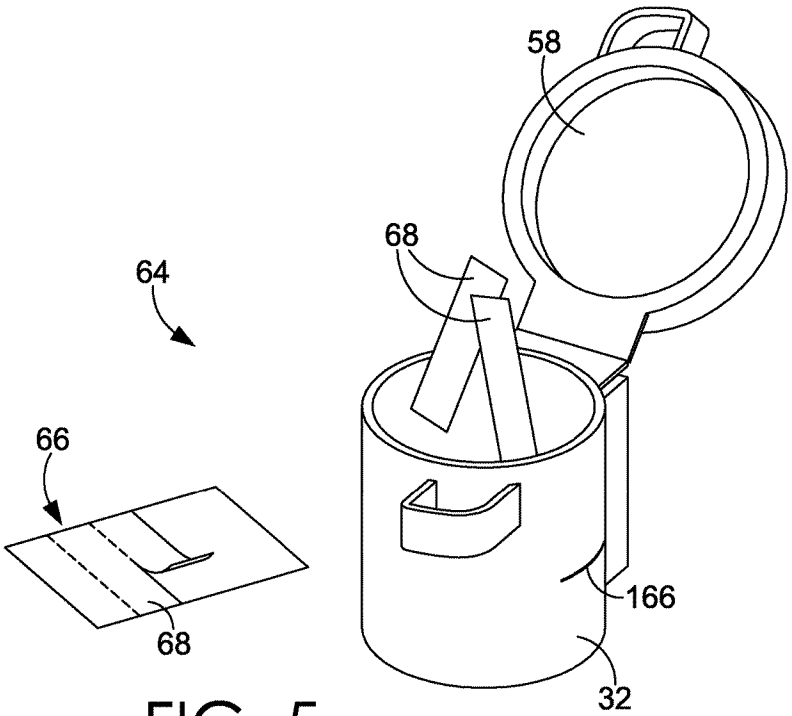
FIG. 5 is a perspective view of the paint pot of FIG. 4, showing the addition of paint strips to the paint pot, in accordance with an embodiment of the invention.

With reference next to FIG. 5, an exemplary perspective view 64 of a paint pot 32 is shown including the addition of paint strips 68 to the paint pot 32, in accordance with an embodiment of the invention. In one embodiment, paint pot 32 includes a fill line 166 indicating a threshold amount of base paint for addition to the paint pot 32. In embodiments, the paint strips 68 may be retrieved by a user from the paint sheet 66, having a plurality of individual paint strips 68 designated by perforations on the surface of the paint sheet 66. In embodiments, paint sheet 66 and/or individual paint strips 68 are made from a dissolvable material embedded with an amount of colorant and/or dye for combining with a base paint 62 using the paint-making device 10. For example, paint sheet 66 may be any colorant material configured to dissolve in a paint solution, such as a paint-dissolvable paper, sheet, film, and the like.

Figure 6A:
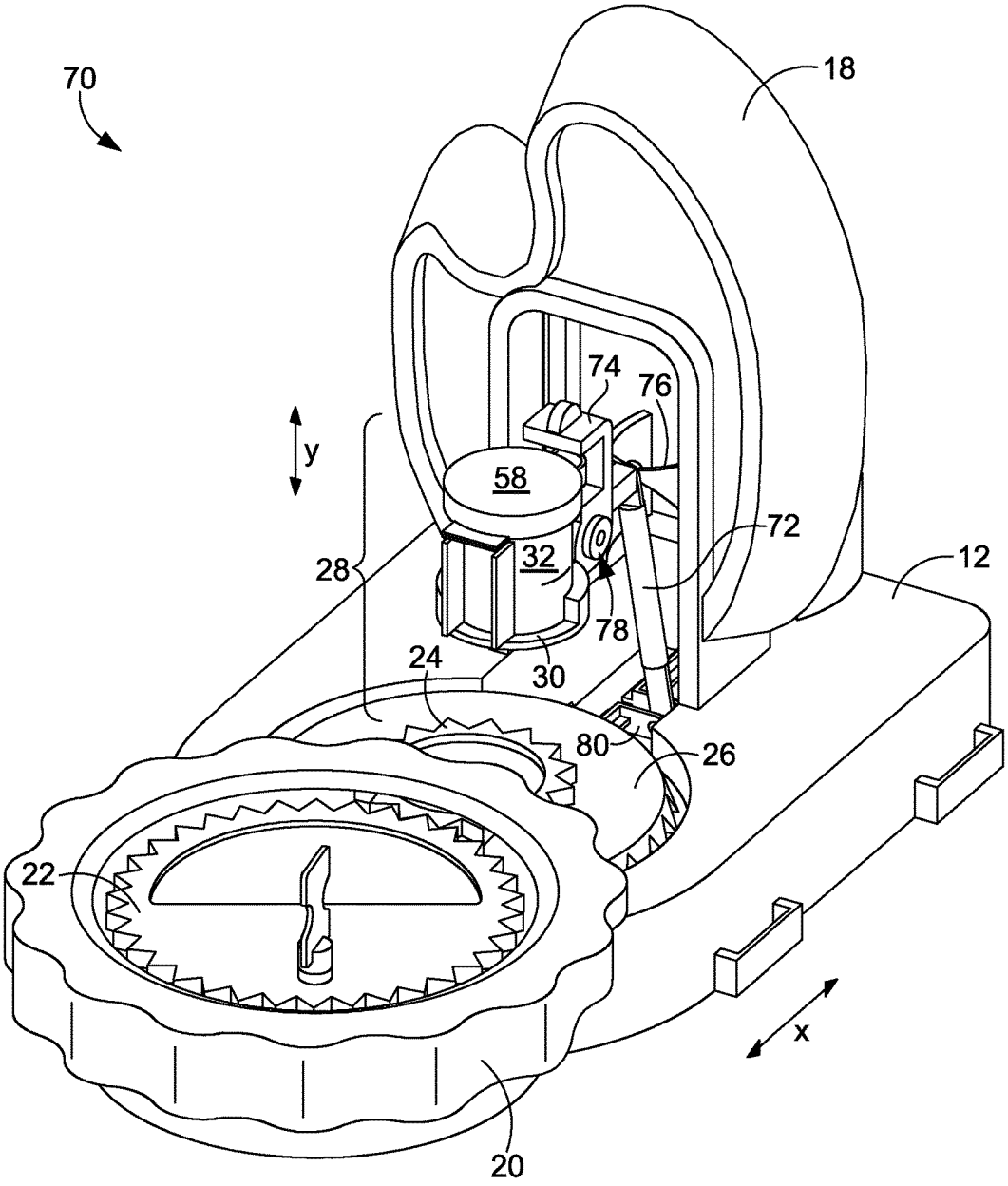
FIG. 6A is a perspective view of the base of the paint-making device of FIG. 1, in accordance with an embodiment of the invention.

Turning next to FIG. 6A, a perspective view 70 depicts the base 12 of the paint-making device of FIG. 1, in accordance with an embodiment of the invention. The base 12 includes a paint pot shaking component 28 having a slide crank arm 72 coupled to a paint pot harness mount 74 coupled to the slide bracket 76. Additionally, the paint pot harness mount 74 is adjacent a side and/or top portion of the paint pot 32, while the paint pot harness 30, coupled to the paint pot harness mount 74, supports a bottom surface of the paint pot 32. In embodiments, the vertical movement of the slide crank arm 72 causes movement of the paint pot shaking component 28 based on travel of the slide bracket 76 along a portion of the interior of the vertical piston side support 18. In embodiments, during mixing with the paint-making device, the travel of the slide crank arm 72 causes movement of the paint pot harness mount 74 and/or paint pot harness 30 about joint 78. In further embodiments, rotation of the slide crankshaft 80 about the horizontal x axis causes vertical slide crank arm 72 to travel, and agitate paint pot shaking component 28.

Figure 6B:
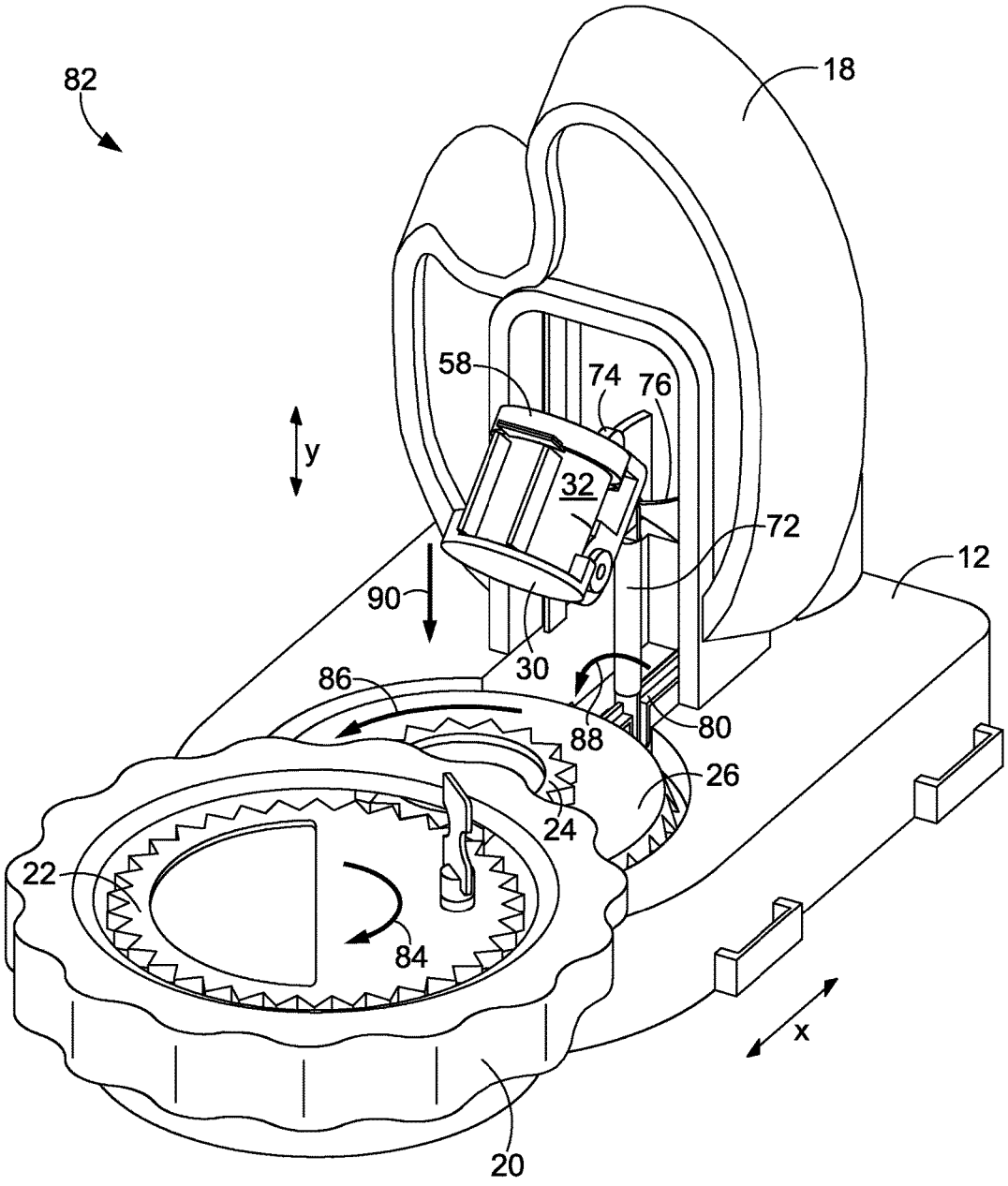
FIG. 6B is a perspective view of the base of the paint-making device of FIG. 1, depicting downward motion of the paint pot secured by components of the paint-making device, in accordance with an embodiment of the invention.

As shown in FIG. 6B, a perspective view 82 of the base 12 depicts the downward motion of the paint pot 32 secured by components of the paint-making device, in accordance with an embodiment of the invention. In embodiments, in response to rotation of the crank gear 22 in a first direction 84, combination gear 26 rotates in a second direction 86, which in turn rotates the slide crankshaft 80 in a third direction 88. In one example, crank gear 22 is rotated in a clockwise, first direction 84, while adjoining combination gear 26 is rotated in a counterclockwise, second direction 86. Accordingly, the paint pot shaking component 28 produces travel of the paint pot 32 in a downward direction 90 in response to rotation of the slide crankshaft 80 in the third direction 88. In embodiments, the paint-making device is configured for use by both right-handed and left-handed users. For example, the paint-making device is configured to agitate the paint pot 32 based on rotation of the crank gear 22 in either a clockwise or a counterclockwise direction.

Figure 6C:
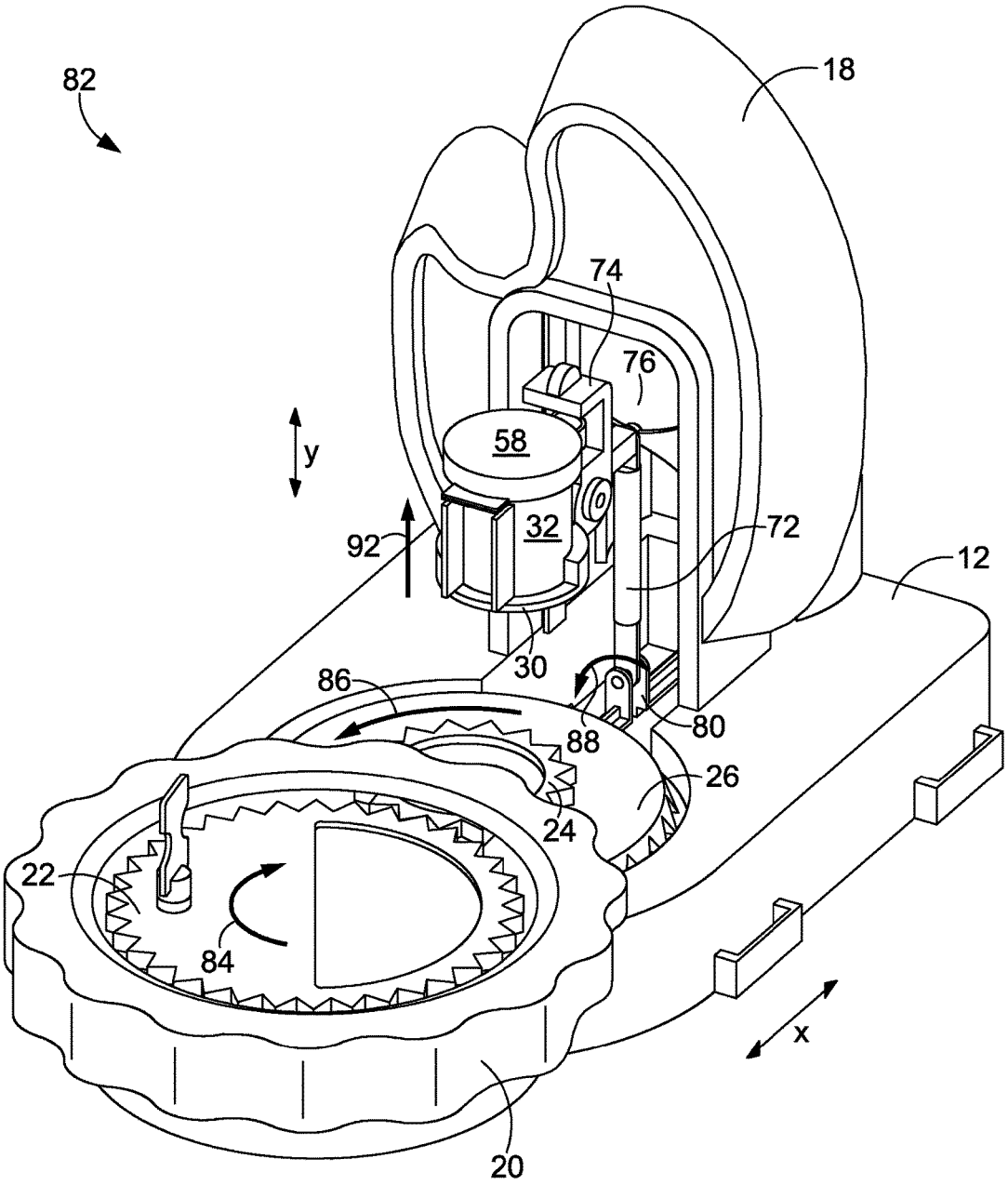
FIG. 6C is a perspective view of the base of the paint-making device of FIG. 1, depicting upward motion of the paint pot secured by components of the paint-making device, in accordance with an embodiment of the invention.

Turning next to FIG. 6C, based on continued rotation of the crank gear 22 in the first direction 84 (and the corresponding, continued rotation of the combination gear 26 in the second direction 86 and the slide crankshaft 80 in the third direction 88), travel of the paint shaking component in an upward direction 92 causes the continued mixing of the contents of paint pot 32, in accordance with an embodiment of the invention. In embodiments, repeated rotation of the slide crankshaft 80 corresponds to repeated upward and downward travel of the slide bracket 76 coupled to the slide crank arm 72 and the paint pot harness mount 74. As shown in the exemplary embodiment of FIGS. 6B-6C, the rotation of the slide crankshaft 80 generates a rapid and repeated upward and downward translation, within a particular range of motion as determined at least in part by one or more features of the paint pot harness mount 74.

Figure 7:
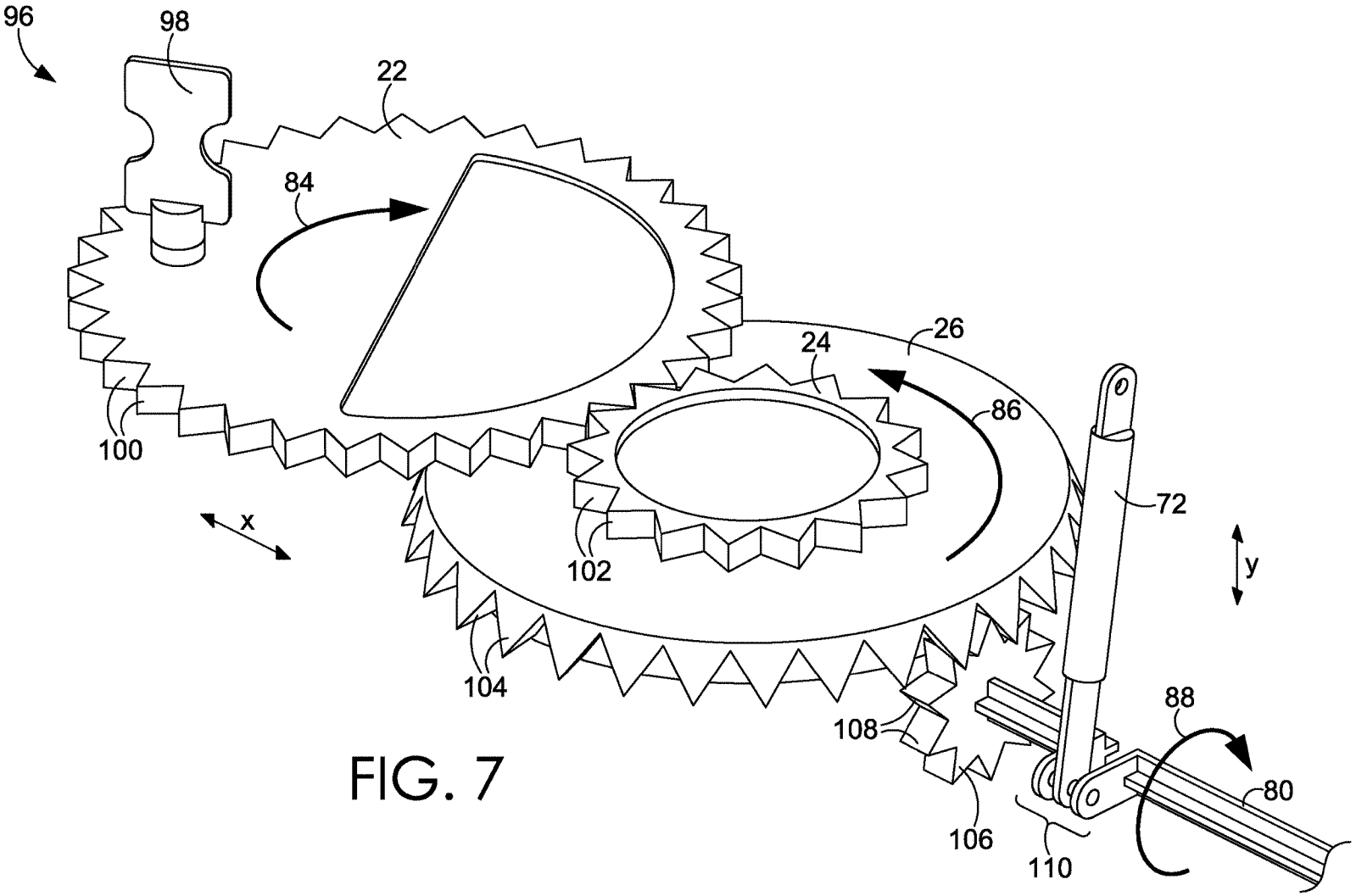
FIG. 7 is an enlarged, rear perspective view of the components of the center portion of the paint-making device, in accordance with an embodiment of the invention.

Turning now to FIG. 7, multiple exemplary components of the center portion 96 of the paint-making device 10 are provided, in accordance with an embodiment of the invention. In embodiments, the handle 98 coupled to the crank gear 22 is used to rotate the crank gear 22 in a first direction 84. As discussed above, although the exemplary embodiment depicts the first direction 84 being a clockwise direction, it should be understood that the first direction 84 may be a counterclockwise direction for turning the crank gear 22. For example, in further embodiments of the invention, the paint-making device is configured to agitate and/or mix a paint inside a paint pot 32 based on counterclockwise rotation of the crank gear 22, clockwise rotation of the combination gear 26, and corresponding rotational movement of the slide crankshaft 80.

As shown in FIG. 7, crank gear 22 includes multiple gear teeth 100 along an outer edge and/or circumference. Accordingly, the multiple gear teeth 100 are engaged against multiple gear teeth 102 along a raised portion 24 of the combination gear 26. Based on coupling the multiple gear teeth 100 to the multiple gear teeth 102, combination gear 26 is rotated in a second direction 86 (upon rotation of the crank gear 22 in the first direction 84), while multiple gear teeth 104 of the combination gear 26 are engaged against multiple gear teeth 108 on slide crankshaft gear 106. Accordingly, in embodiments of the invention, rotation of slide crankshaft gear 106 and slide crankshaft 80 in a third direction 88 causes travel and/or rotation of at least a portion of the slide crank arm 72, such as travel in an upward and downward direction. Such travel of the slide crank arm 72 provides corresponding agitation of the paint pot shaking component 28. As further shown in the exemplary embodiment of FIG. 7, the slide crankshaft 80 may include a slide crankshaft joint 110 that is rotated in association with the rotation of slide crankshaft 80, and generates a corresponding movement of the slide crank arm 72. In some embodiments of the invention, as further discussed below, agitation of the paint pot shaking component 28 is generated based on travel of the slide crank arm 72, as activated by the rotation of the slide crankshaft joint 110 and the slide crankshaft 80, in response to rotation of the slide crankshaft gear 106 (having gear teeth 108), which turns in response to rotation of the combination gear 26, which also turns in response to rotation of the crank gear 22, as directed by a user manipulating the handle 98.

Embodiments of the combination gear 26 may include two sets of gear teeth (e.g., 102 and 104) and be of a unitary construction. Alternatively, a first set of gear teeth, about a first gear, may be attached to a second set of gear teeth about a second gear, such that rotation of the first gear in a first direction also causes rotation of the second gear in the first direction. Further, the shape of the multiple gear teeth 100, 102, 104 and 108 are not intended to be limited by the drawing figures. For example, the distal end of the gear teeth may have a different shape and/or configuration, such as a rounded shape for engaging against an adjacent gear tooth. The multiple gear teeth may also have varying sizes, to the extent that the variation in size allows the gear teeth of the different gears to interact with adjacent and/or corresponding gear teeth.

In additional embodiments, the center portion 96 of the paint making device may be oriented in a variety of ways. For example, with further reference to FIG. 7, if the x and y axis were reversed, the crank gear and combination gear could be vertically oriented, while the slide crank arm could be horizontally oriented. This would result in a horizontal motion of the paint pot harness mount to create the shaking effect. In another embodiment, the crank gear, the combination gear, and a third gear could be combined in the same plane. The third gear could have an offset joining mechanism attached to a crank arm. In this scenario, the interaction of the gears and the offset position of the joining mechanism to the crank arm could provide vertical or horizontal rotational movement.

Figure 8:
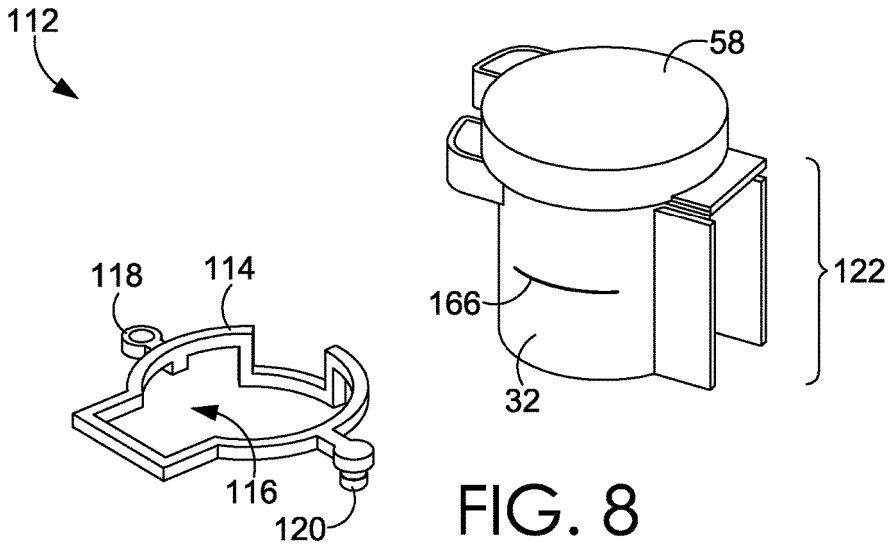
FIG. 8 is a perspective view of a paint pot and corresponding paint pot pivot link, in accordance with an embodiment of the invention.
Figure 9:
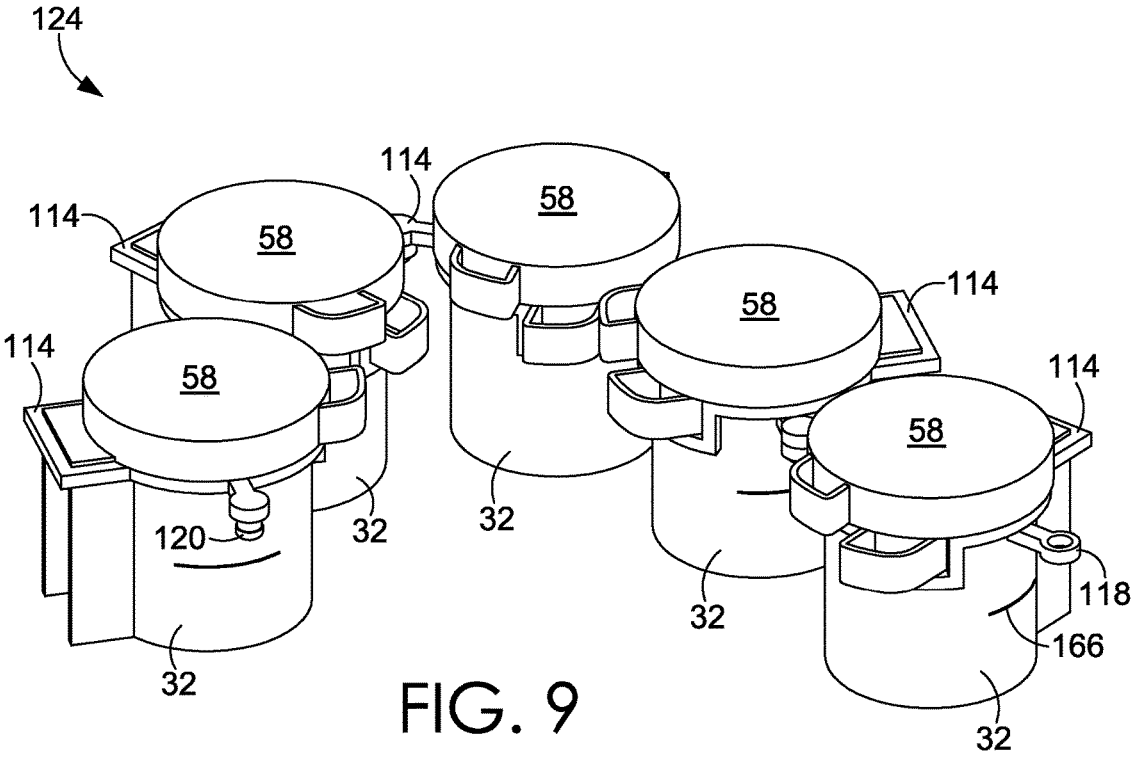
FIG. 9 is a perspective view of multiple paint pots coupled together using multiple paint pot pivot links, in accordance with an embodiment of the invention.

In the embodiment of FIG. 8, a perspective view 112 includes a paint pot 32 and corresponding paint pot pivot link 114, in accordance with an embodiment of the invention. As shown in FIG. 8, the paint pot 32 includes an exterior surface 122 having a shape configured to mate with the internal cavity 116 of the paint pot pivot link 114. In embodiments, the paint pot pivot link 114 includes a first connector 118 and a second connector 120 for engaging an adjacent paint pot pivot link 114, as shown in the perspective view 124 of FIG. 9. As shown in the embodiment of FIG. 9, a first connector 118 is configured to mate with a second connector 120 to form an interconnected series of paint pot pivot links 114.

Figure 10:
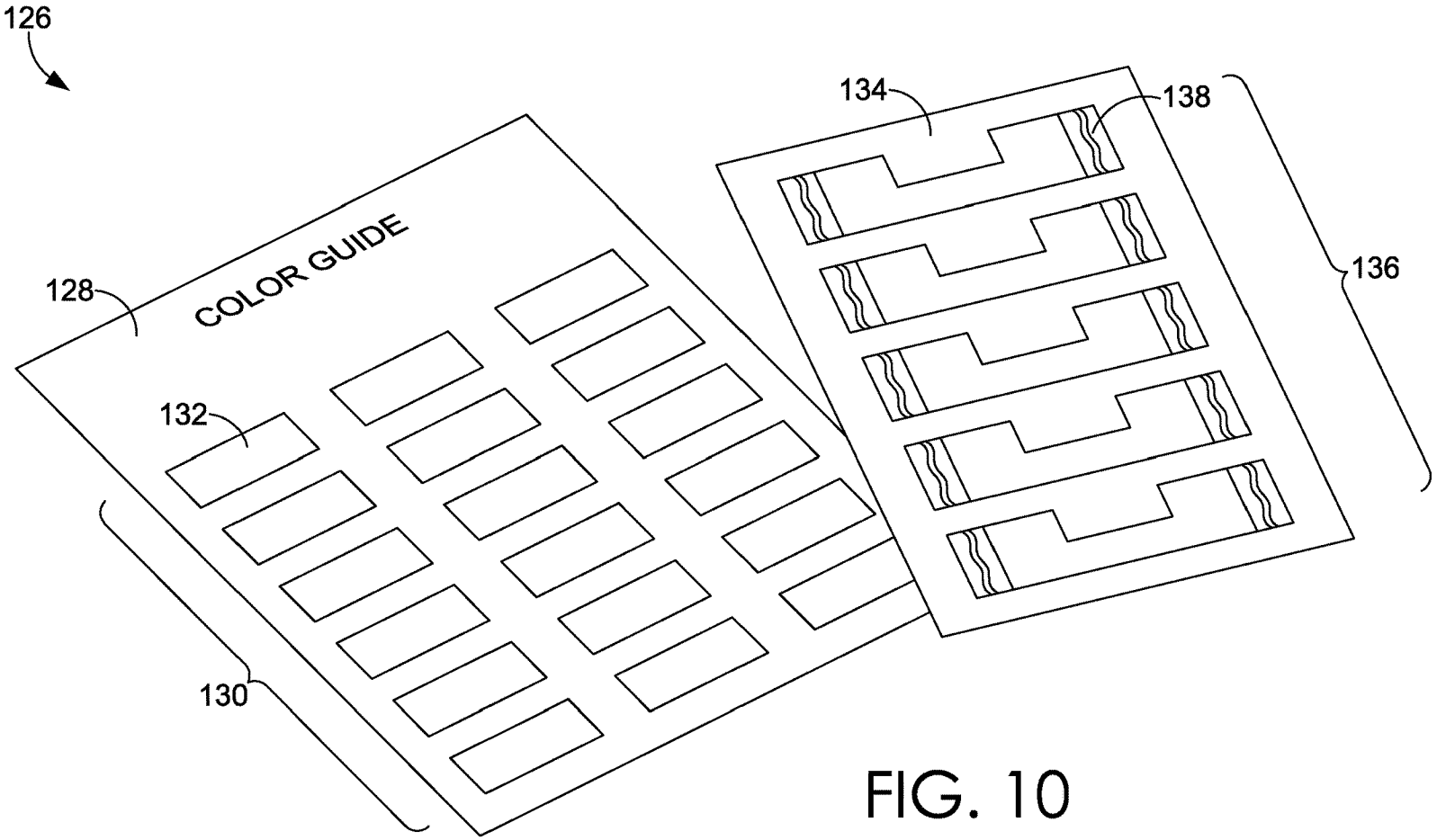
FIG. 10 is a perspective view of a color mixing chart and a paint pots label sheet, in accordance with an embodiment of the invention.

Referring next to FIG. 10, a perspective view 126 of an exemplary color-mixing chart 128 is depicted as including multiple color combinations 130, such as individual directions 132 for a user to mix paint with the paint-making device 10. In embodiments, the color-mixing chart 128 and/or color-mixing guide demonstrates the creation of specific color shades based on suggested amounts and/or combinations of two or more different strips of paint. Accordingly, the color-mixing chart 128 may provide information on a ratio (i.e., number of paint strips) of each color for combining to produce a designated shade of color. In some embodiments, the paint-making device 10 also includes a paint pot label sheet 134 having multiple paint pot labels 136. In embodiments, the individual paint pot labels 138 may be applied to an exterior surface 122 of a paint pot 32, in accordance with an embodiment of the invention.

Figure 11:
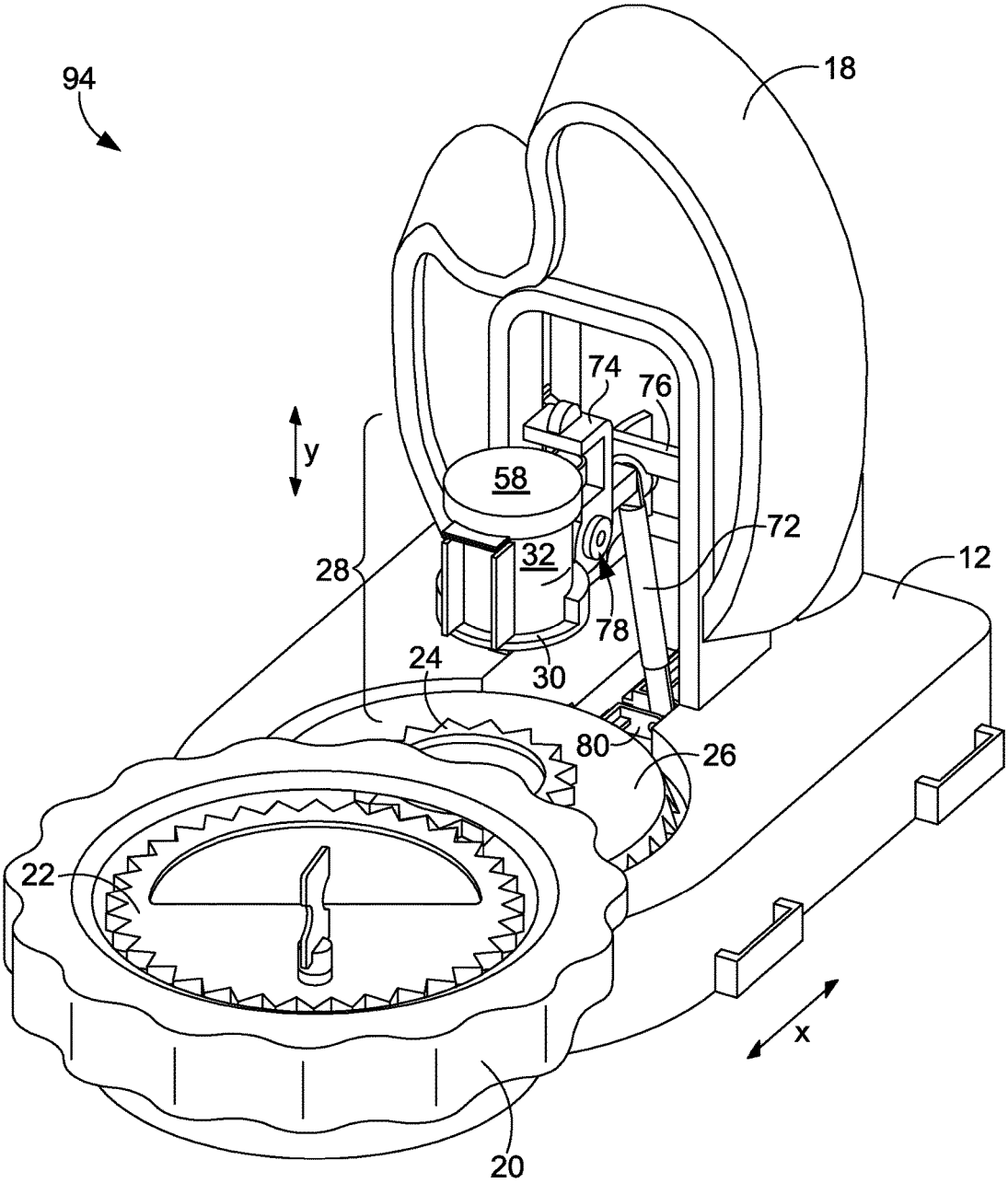
FIG. 11 is a perspective view of the base of the paint-making device, in accordance with an embodiment of the invention.

With reference to FIG. 11, a perspective view 94 of the base 12 of the paint-making device is depicted in accordance with an embodiment of the invention. In the embodiment of FIG. 11, the slide bracket 76 is configured to translate within a cavity along an internal perimeter of the vertical piston side support 18.

Figure 12B:
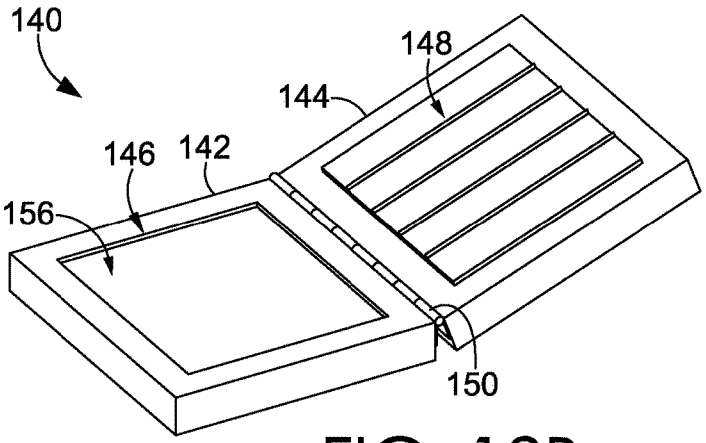
FIG. 12B is a perspective view of the paint-strip embossing device of FIG. 12A, with an unembossed paint strip in a lower portion of the device, in accordance with an embodiment of the invention.
Figure 12A:
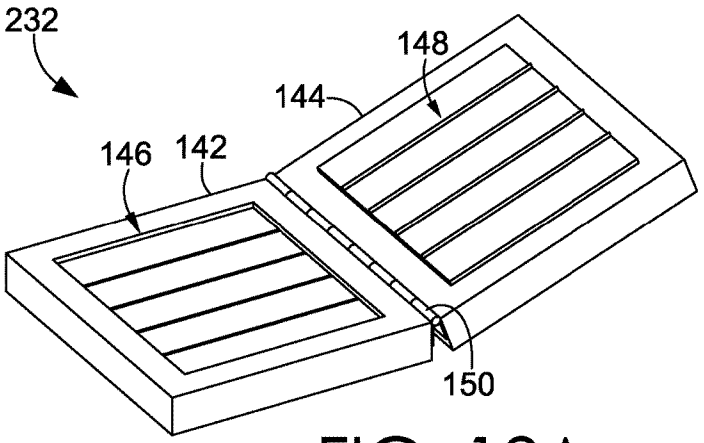
FIG. 12A is perspective view of a paint-strip embossing device in an open position, in accordance with an embodiment of the invention.
Figure 12D:
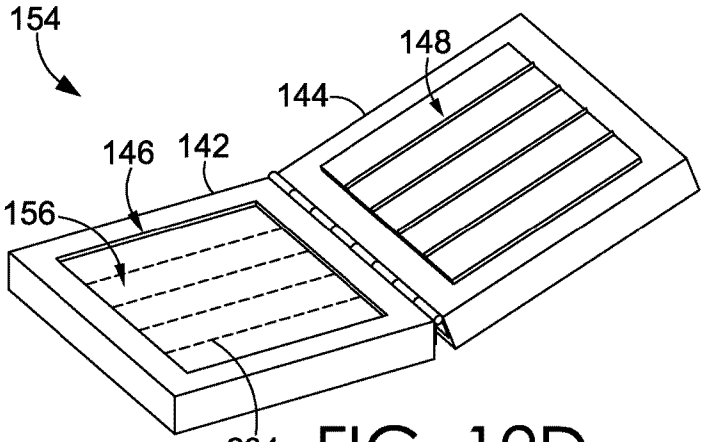
FIG. 12D is a perspective view of the paint-strip embossing device of FIG. 12A, in an open position upon embossing the paint strip, in accordance with an embodiment of the invention.
Figure 12C:
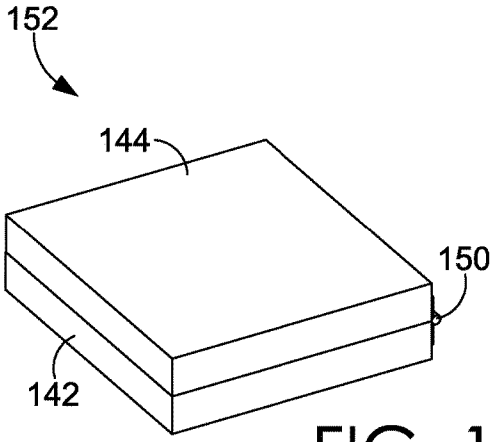
FIG. 12C is a perspective view of the paint-strip embossing device of FIG. 12A, in a closed position, in accordance with an embodiment of the invention.

Turning next to FIGS. 12A-12D, an exemplary paint-strip embossing device is provided. In FIG. 12A, a perspective view of a paint-strip embossing device 232 is depicted in an open position, with a lower portion 142 hingedly coupled to an upper portion 144 at hinge 150. In embodiments, lower portion 142 includes an embossing cavity 146 having at least one channel configured to couple to at least one rib on the surface of the embossing platform 148. In the embodiment of FIG. 12B, the paint-strip embossing device 140 includes a paint strip 156 positioned within the embossing cavity 146 of lower portion 142. As such, upon closing the paint-strip embossing device 152 as shown in FIG. 12C, the paint strip 156 becomes sandwiched between the plates of the upper portion 144 and lower portion 142. In embodiments, upon contacting the top surfaces of the upper and lower portions 144 and 146, both the embossing cavity 146 and the embossing platform 148 securely contact the paint strip 156. In some embodiments, upon re-opening the paint-strip embossing device 154, the paint strip 156 becomes demarcated by one or more embossed lines 234 that correspond to the channels of embossing cavity 146 and the ribbed features of the embossing platform 148, as shown in FIG. 12D.

With reference to FIG. 13A-13D, exemplary rotational and/or "whipping" motion of the paint pot harness mount 74 is shown according to an embodiment of the invention. In the side view 158 of FIG. 13A, a paint pot harness mount 74 is shown in a stationary position, with a locking dimple 160 configured to couple to at least a portion of the replaceable cap 58 of the paint pot 32. In further embodiments of the invention, the paint pot harness mount 74 may include further surface features configured to couple to at least a portion of a mixing container, such as a paint pot 32. As such, the locking dimple 160 is one example of a feature of the paint pot harness mount 74 configured to secure an exemplary mixing compartment or container during agitation (e.g., the paint pot 32 having a replaceable cap 58 that couples to the locking dimple 160).

Figure 13A:
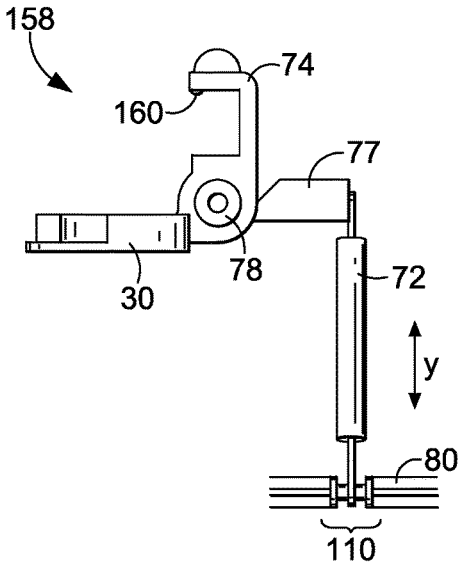
FIG. 13A is an enlarged, side view of a paint pot harness, in accordance with an embodiment of the invention.
Figure 13B:
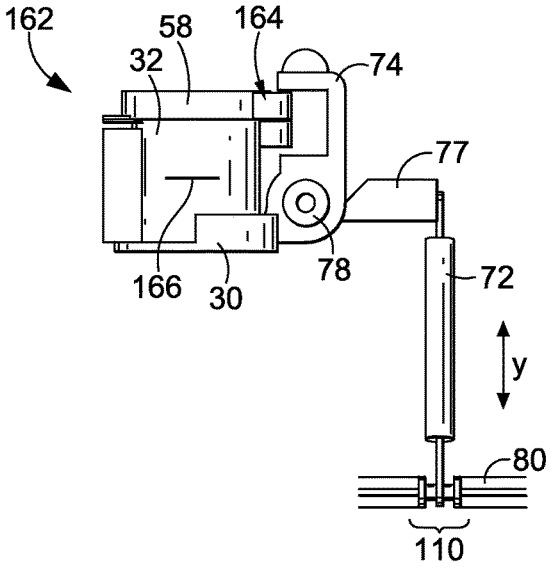
FIG. 13B is an enlarged, side view of the paint pot harness of FIG. 13A, securing a paint pot for mixing, in accordance with an embodiment of the invention.
Figure 13C:
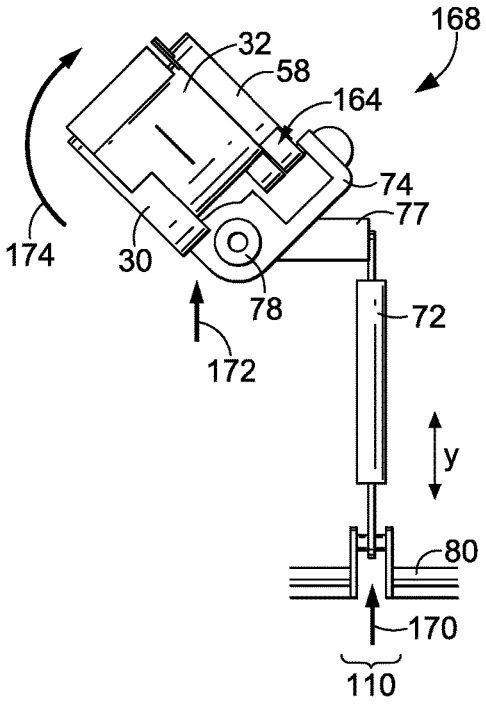
FIG. 13C is an enlarged, side view of the paint pot harness of FIG. 13B, depicting travel of the paint pot harness at an upward-most position, in accordance with an embodiment of the invention.

In the side view 162 of FIG. 13B, an exemplary paint pot 32 includes a locking feature 164 configured to couple to the locking dimple 160 of the paint pot harness mount 74. As such, as shown in FIG. 13B, the locking dimple 160 is coupled to at least a portion of the locking feature 164, thereby securing the paint pot 32 in a locked position. In some embodiments of the invention, interaction between the locking feature 164 and at least a portion of the paint pot harness mount 74, such as the locking dimple 160, may further secure the paint pot 32 during agitation in addition or alternative to the secured placement of the paint pot 32 within the partially flanged perimeter/edge of the paint pot harness 30.

In some embodiments of the invention, rotation of the slide crankshaft 80 causes raising and lowering of the slide crank arm 72 in an upward and downward direction. Accordingly, as shown in the side view 168 of FIG. 13C, rotation of slide crankshaft 80 causes slide crankshaft joint 110 to travel in an upward direction 170, causing a corresponding movement of slide crank arm 72 in an upward direction 172. Accordingly, paint pot harness mount 74, upon movement in the upward direction 172, continues to rotate about joint 78 in a clockwise direction 174 during upward travel of the paint pot 32.

Figure 13D:
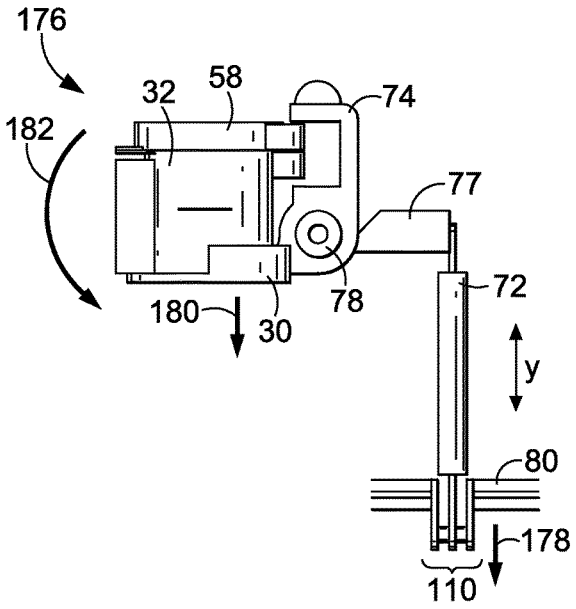
FIG. 13D is an enlarged, side view of the paint pot harness of FIG. 13B, depicting travel of the paint pot harness at a downward-most position, in accordance with an embodiment of the invention.

As shown in the exemplary side view 176 of FIG. 13D, upon further rotation of the slide crankshaft 80, slide crankshaft joint 110 rotates around into a downward direction 178, causing corresponding travel of the slide crank arm 72 in a downward direction 180. Accordingly, paint pot harness mount 74, upon movement in the downward direction 180 towards a neutral position (parallel to slide crankshaft 80), causes rotation downward in a counterclockwise direction 182 about joint 78.

In some embodiments of the invention, the paint-making device includes a jointed armature 77 to provide enhanced "whipping" rotation of the paint pot harness mount 74 (that secures a paint pot 32) about a joint 78. In further embodiments, repeated rotation of one or more gears coupled to the slide crankshaft 80 causes repetitive motion of the paint pot harness mount 74 in a whipping motion. For example, repetitive motion of the paint pot harness mount 74 in a first direction (e.g., clockwise direction 174) during travel in a first direction of the slide crank arm 72 (e.g., upward travel in direction 172), followed by repetitive motion of the paint pot harness mount 74 in a second direction (e.g., counterclockwise direction 182) during travel in a second direction of the slide crank arm 72 (e.g., downward travel in direction 180), causes whipping motion of the paint pot harness mount 74, and corresponding paint pot 32, between a rotated upward position and a horizontal position (and/or a rotated downward position relative to the opposing rotated upward position). In further embodiments, rotation about at least one joint of the paint pot shaking component 28 causes repetitive upward and downward travel of the paint pot 32, thereby mixing the contents of the paint pot 32. In one embodiment, the upward, whipping motion of the paint pot harness mount 74 causes repeated rotation within a threshold range of motion about the joint 78, corresponding to an amount of rotation of at least one gear of the paint-making device.

Further, in some embodiments, the paint pot harness mount 74 has an opening (not shown) for receiving the jointed armature 77, such that the paint pot harness mount 74 may be pivotably coupled to the jointed armature at joint 78. In embodiments, the jointed armature 77 is attached to the slide crank arm 72 and the slide bracket 76. The jointed armature 77 may be joined with the paint pot harness mount 74 at the joint 78. In one embodiment, at least a portion of the jointed armature 77 may provide a travel stop to the rotatable/pivotable paint pot harness mount 74. As such, an angled outer edge of the jointed armature 77 may provide a travel stop to a back surface of the paint pot harness mount 74 that contacts the angled outer edge of the jointed armature 77 at the end of a range of motion (i.e., upon upward rotation towards the travel stop).

In some embodiments, an opening on the paint pot harness mount 74 for receiving the jointed armature 77 may include a top edge (not shown) configured to contact at least a portion of the jointed armature 77 when the paint pot harness 30 is moving upward. For example, the top edge of an opening on the back side of the paint pot harness mount 74 may include a travel stop that contacts the travel stop on the jointed armature 77. In some aspects, the top edge of the opening (i.e., the opening on the paint pot harness mount 74) for receiving the jointed armature 77 is configured to contact the jointed armature 77 in a way that limits the upward travel of the paint pot harness mount 74 and/or paint pot harness 30. For example, further upward travel of the paint pot 32 may be limited based on contact between a travel stop on the paint pot harness mount 74 and a corresponding travel stop on the jointed armature 77. In further embodiments, the opening for receiving the jointed armature 77 may have two back edges (not shown) capable of contacting at least a portion of the jointed armature 77, the two back edges being configured to contact the jointed armature 77 in a way that limits the downward travel of the paint pot harness 30. In an alternate embodiment, the opening for receiving the jointed armature 77 may have the bottom edge (not shown) opposite the top edge (not shown), capable of contacting the jointed armature 77 to limit downward travel of the paint pot harness. As such, at least a portion of the jointed armature 77 may serve as a downward travel stop for "whipping" the paint pot harness mount 74 in an opposite direction and/or returning the paint pot harness mount 74 to a neutral and/or starting position (e.g., FIG. 13D).

Figure 14B:
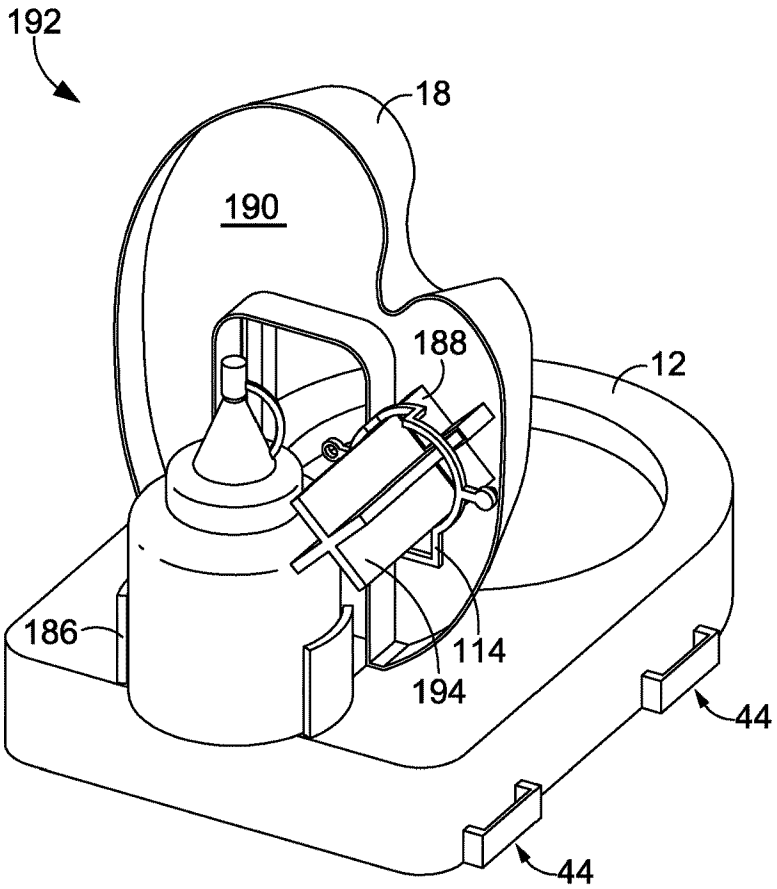
FIG. 14B is a rear, perspective view of the base of FIG. 14A, coupled to a paint bottle and link holder, in accordance with an embodiment of the invention.
Figure 14A:
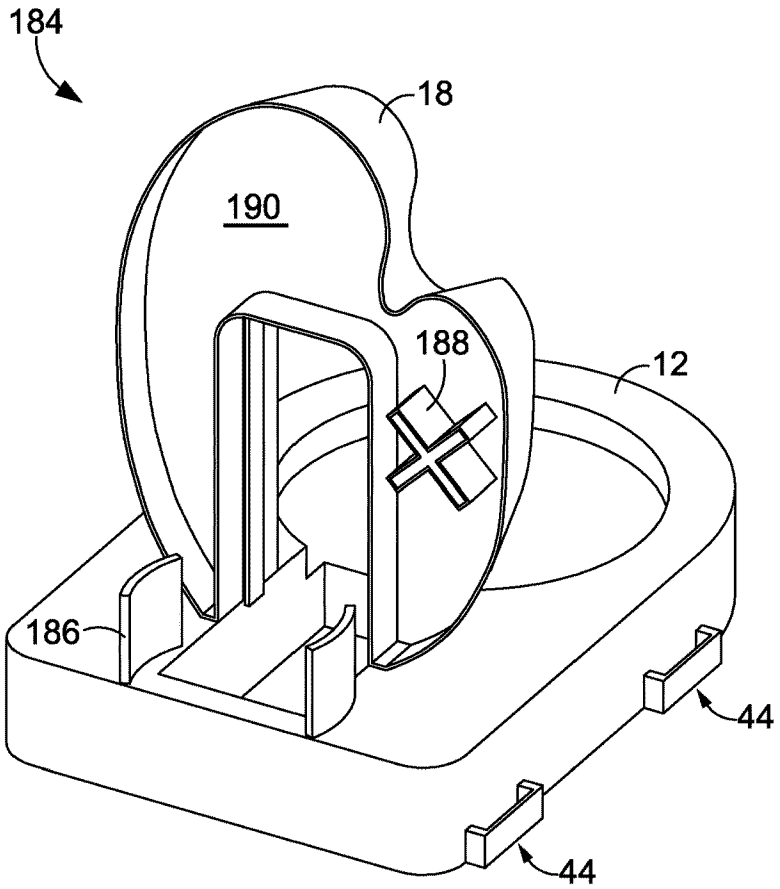
FIG. 14A is a rear, perspective view of the base of the paint-making device, in accordance with an embodiment of the invention.

With reference now to FIG. 14A, a rear, perspective view 184 of the base 12 of an exemplary paint-making device includes a paint bottle holder 186 and a link holder 188 on a back surface 190 of the vertical piston side support 18. Accordingly, as shown in the example of FIG. 14B, a paint bottle may be secured within the paint bottle holder 186 during storage. Similarly, a storage bar 194 may be inserted into a cavity of the link holder 188 to store at least one paint pot pivot link 114.

Figure 15A:
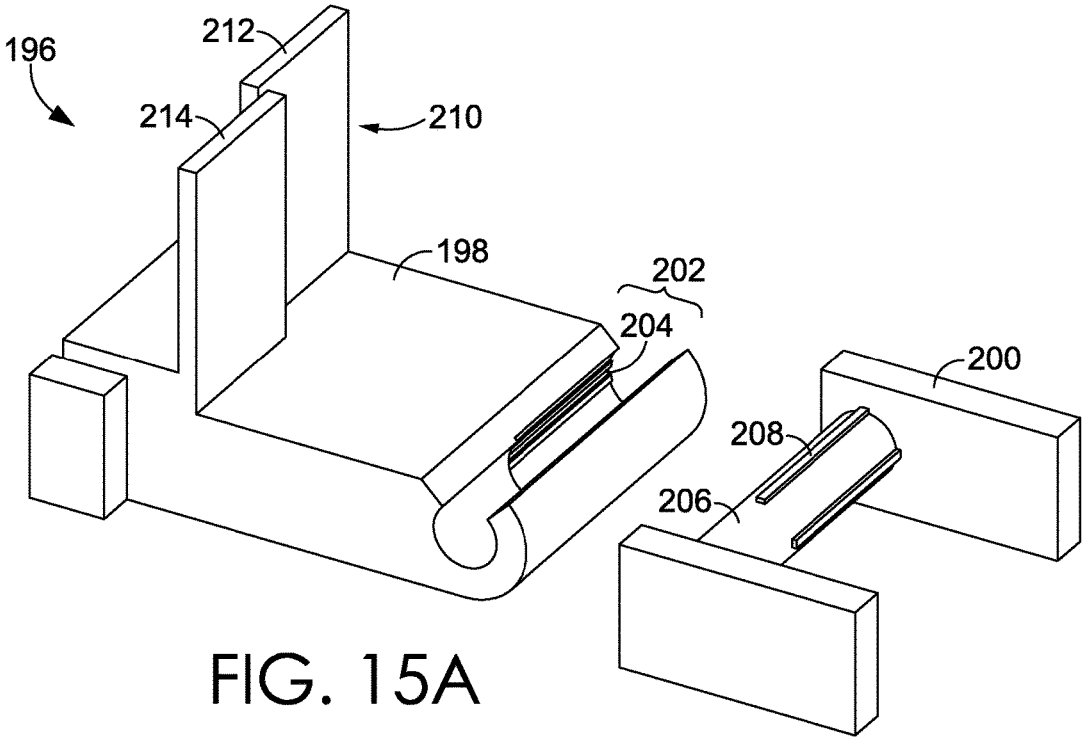
FIG. 15A is an enlarged, perspective view of the link mechanism having detents, in accordance with an embodiment of the invention.
Figure 15B:
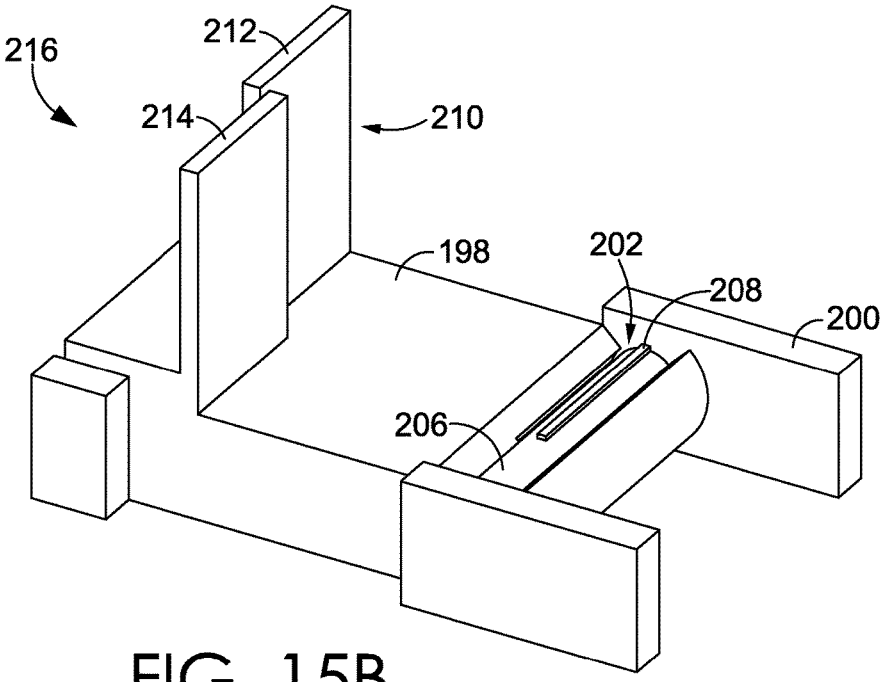
FIG. 15B is an enlarged, perspective view of the links of FIG. 15A coupled together, in accordance with an embodiment of the invention.
Figure 15C:
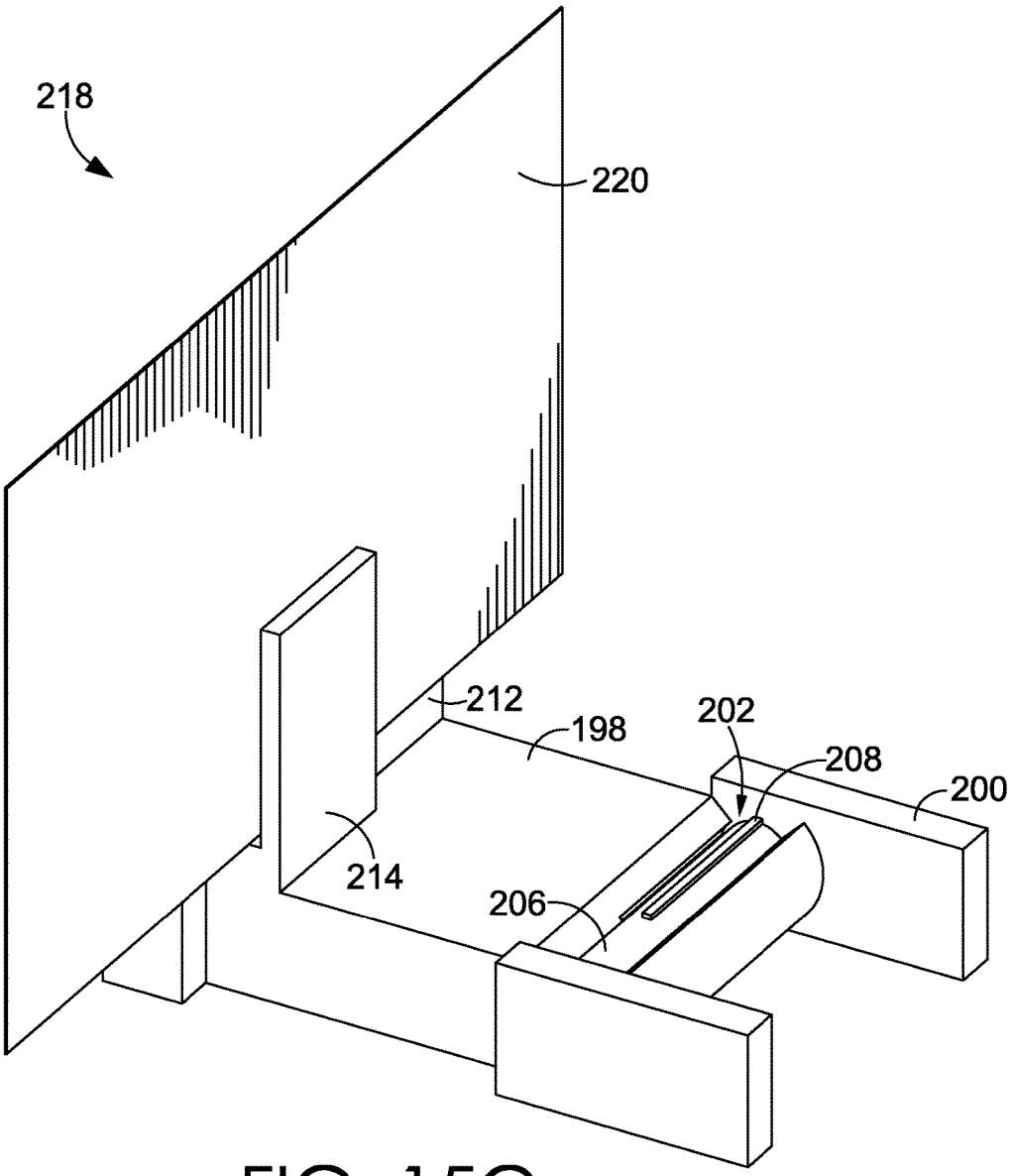
FIG. 15C is an enlarged, perspective view of the link mechanism of FIG. 15B securing a writing surface, in accordance with an embodiment of the invention.

As shown in the embodiment of FIG. 15A, an enlarged, perspective view 196 of an exemplary palette connector hinge clip 44 includes a link mechanism 198 having detents 204 inside a pivot cavity 202. Each of the detents 204 is configured to couple to a corresponding ridge 208 on the rod 206 of clip 200. As such, a clip 200 coupled to a palette, such as a first palette 14 and/or second palette 16, may be configured to couple to a link mechanism 198 coupled to a base 12. As shown in FIG. 15B, upon coupling the link mechanism 198 to the clip 200, a palette coupled to the base 12 of a paint-making device may be secured into one of multiple stationary positions. For example, the palette may be oriented in a horizontal position, such as in FIG. 15B. Similarly, as previously shown in FIG. 2, a link mechanism 198 and clip 200 (i.e., making up an exemplary palette connector hinge clip 44) may secure a palette in a vertical position, perpendicular to the base 12. As further shown in the exemplary embodiment of FIG. 15C, enlarged, perspective view 218 of the link mechanism 198 and clip 200 of FIG. 15B includes a writing surface 220 secured between first vertical support 212 and second vertical support 214. As such, the first vertical support 212 and second vertical support 214 may be used to secure a writing surface 220 within the paint-making device when in a closed position, during storage.

Figure 16B:
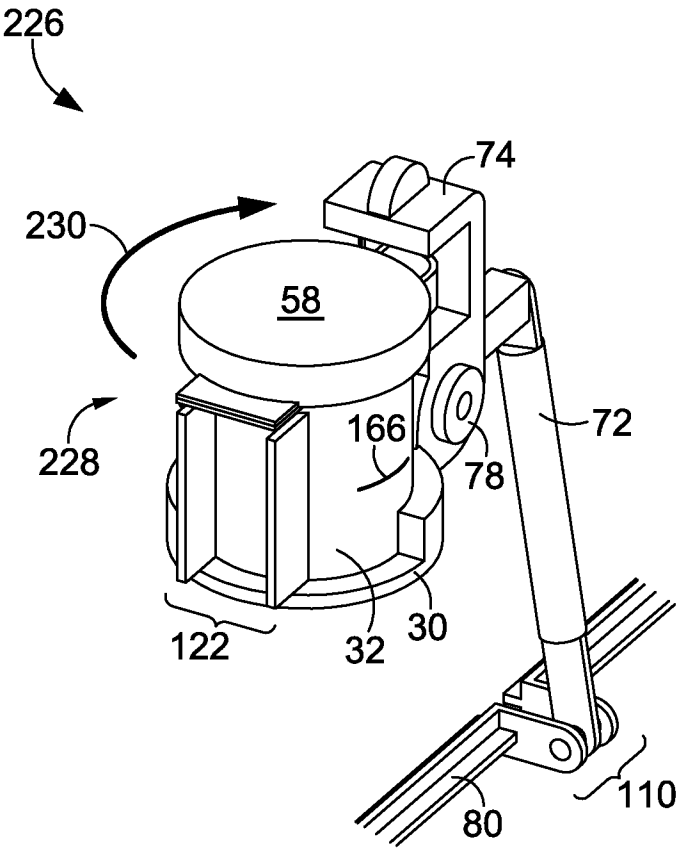
FIG. 16B is an enlarged, perspective view of the paint pot harness in a locked position, in accordance with an embodiment of the invention.
Figure 16A:
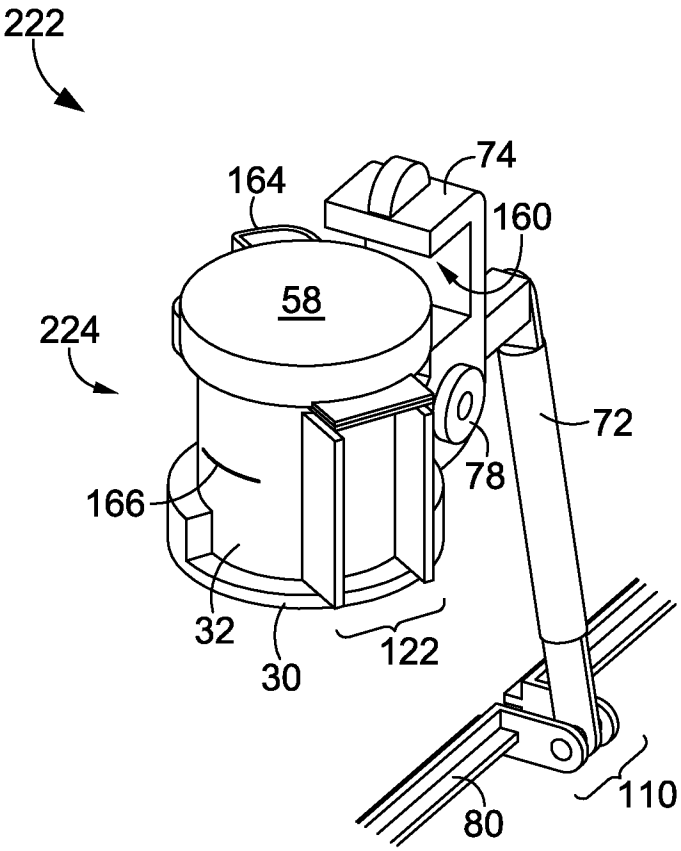
FIG. 16A is an enlarged, perspective view of the paint pot harness in an unlocked position, in accordance with an embodiment of the invention.

Turning now to FIGS. 16A-B, an enlarged, perspective view of the paint pot harness 30 is shown in an unlocked and locked position, in accordance with embodiments of the invention. In FIG. 16A, the top perspective view 222 depicts a paint pot 32 rotated into an unlocked position 224, with the locking feature 164 removed from the locking dimple 160 on paint pot harness mount 74. In embodiments, the paint pot harness 30 includes an opening on an outer perimeter that corresponds to the exterior surface 122 of the paint pot 32. As such, a paint pot 32 may be rotated in a clockwise direction 230 into a locked position 228, as shown in the top perspective view 226 of FIG. 16B. In embodiments, based on the surface features of paint pot harness 30 corresponding to the feature(s) on exterior surface 122 of the paint pot 32, the paint pot 32 may be secured during upward and downward travel of the paint pot harness mount 74 (i.e., the whipping motion of the paint pot shaking component). In further embodiments, paint pot harness 30 is configured to couple to multiple different shapes of paint pots, including containers having alternative and/or additional exterior features that correspond to a perimeter of the paint pot harness 30 surface.

Accordingly, in embodiments of the invention, a user of the paint-making device 10 may select a desired combination of paint strips 68 for combination with a minimum amount of base paint 62 inside a paint pot 32. Having added both the desired combination of paint strips 68 and the base paint 62 to the paint pot 32, the replaceable cap 58 is secured to the body of the paint pot 32 for mixing by the paint-making device. A user may secure the paint pot 32 against at least a portion of the paint pot shaking component 28, such as by securing the bottom surface of the paint pot 32 against the paint pot harness 30, while coupling at least the top or side surface of the paint pot 32 against the paint pot harness mount 74. As discussed above, a user may then rotate the handle 98 coupled to the crank gear 22 to produce the corresponding rotation of the combination gear, rotation of the slide crankshaft gear, rotation of the slide crankshaft, and vertical (i.e., up and down) travel of the slide crank arm, which triggers repetitive, upward and downward motion of the paint pot shaking component 28.

In some embodiments, the rate of rotation of the crank gear 22 by a user corresponds to a rate of shaking by the paint pot shaking component 28. For example, continued rotation of the slide crankshaft 80 causes travel of the slide crank arm 72 in an upward and downward direction based on coupling of the slide crank arm 72 to the slide crankshaft 80 at the slide crankshaft joint 110. As shown in exemplary FIG. 7, the slide crankshaft joint 110 includes, in some embodiments, an extended portion of the slide crankshaft 80 that projects from the surface of the slide crankshaft 80. Such extended portion is configured to couple to the end portion of the slide crank arm 72 at a distance apart from the central axis of the slide crankshaft 80. Accordingly, the speed of rotation of slide crankshaft joint 110 corresponds to a speed of upward and downward agitation of a paint pot 32 coupled to the paint pot shaking component 28. In further embodiments, based on agitation and/or shaking of the paint pot (including the paint strip(s) 68 and base paint 62), the paint solution is manually mixed, without needing to stir and/or disrupt the contents of the paint pot 32. In further embodiments, the crank gear 22 is rotated a minimum number of times to produce a desired mixture of the paint produced with the selected paint strips 68 and base paint 62.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A paint-making device comprising:

a base;

a paint pot shaking component coupled with the base, the paint pot shaking component comprising:

a handle;

a slide crankshaft coupled with the handle;

a slide crankshaft joint coupled with and radially offset from the slide crankshaft; and a slide crank arm coupled with and generally perpendicular to the slide crankshaft joint; and a paint pot harness mount pivotably coupled with the slide crank arm, wherein the paint pot shaking component is effective to repetitively rotate the paint pot harness mount with respect to the slide crank arm about a pivot joint.

2. The paint-making device of claim 1, further comprising a vertical side support coupled with the base.

3. The paint-making device of claim 2, further comprising a slide bracket coupled with the slide crank arm and slidably engaged with the vertical side support.

4. The paint-making device of claim 1, wherein the paint pot shaking component comprises a crank gear coupled with the handle.

5. The paint-making device of claim 4, wherein the paint pot shaking component comprises a combination gear adjacent to and engaged with the crank gear.

6. The paint-making device of claim 5, wherein the paint pot shaking component comprises a slide crankshaft gear coupled with the slide crankshaft, the slide crankshaft gear being perpendicular to and engaged with the combination gear.

7. The paint-making device of claim 1, wherein the paint pot shaking component is effective to cause a reciprocal translational movement of the paint pot harness mount vertically with respect to the base.

8. A paint-making device comprising:

a base;

a paint pot shaking component coupled with the base, the paint pot shaking component comprising:

a manually powered handle;

a slide crankshaft rotatably coupled with the manually powered handle and oriented generally parallel to the base; and a slide crank arm coupled with the slide crankshaft and oriented generally perpendicular to the slide crankshaft and the base; and a paint pot harness mount vertically spaced apart from the base and pivotably coupled with the slide crank arm, wherein vertical translational movement of the slide crank arm causes the paint pot harness mount to rotate with respect to the jointed armature about a pivot joint.

9. The paint-making device of claim 8, wherein a manipulation of the manually powered handle causes a rotation of the slide crankshaft about a generally horizontal axis of rotation.

10. The paint-making device of claim 9, wherein the rotation of the slide crankshaft about the generally horizontal axis of rotation causes a vertical translational movement of the slide crank arm.

11. The paint-making device of claim 10, wherein the vertical translational movement of the slide crank arm causes a corresponding translational movement of the paint pot harness mount.

12. The paint-making device of claim 11, wherein the slide crank arm comprises a jointed armature pivotably coupled with the paint pot harness mount.

13. A paint-making device comprising:

a base;

a paint pot shaking component coupled with the base, the paint pot shaking component comprising:

a handle;

a slide crankshaft rotatably coupled with the handle and generally parallel to the base; and a slide crank arm coupled with the slide crankshaft and generally perpendicular to the slide crankshaft and the base;

a paint pot harness mount vertically spaced apart from the base and pivotably coupled with the slide crank arm; and a first palette and a second palette hingedly coupled with the base at laterally opposing sides of the base.

14. The paint-making device of claim 13, wherein the first palette and the second palette are pivotable between a first position parallel to the base and a second position perpendicular to the base.

15. The paint-making device of claim 14, further comprising a carrying handle having a carrying handle first end and a carrying handle second end.

16. The paint-making device of claim 15, wherein the carrying handle first end is removably coupled with the first palette and the carrying handle second end is removably coupled with the second palette when in the second position.

17. The paint-making device of claim 13, wherein the first palette comprises a plurality of paint pot holders.

18. The paint-making device of claim 13, wherein the second palette comprises a paint strip compartment configured to enclose at least one paint strip and a paint bottle compartment configured to secure at least one paint bottle.

* * * * *